US009307805B2

(12) United States Patent
Tanaka

(10) Patent No.: US 9,307,805 B2
(45) Date of Patent: Apr. 12, 2016

(54) BICYCLE CLEAT POSITIONING KIT

(71) Applicant: Shimano Inc., Sakai, Osaka (JP)

(72) Inventor: Ryoichi Tanaka, Osaka (JP)

(73) Assignee: Shimano Inc., Osaka (JP)

( * ) Notice: Subject to any disclaimer, the term of this patent is extended or adjusted under 35 U.S.C. 154(b) by 373 days.

(21) Appl. No.: 13/870,423

(22) Filed: Apr. 25, 2013

(65) Prior Publication Data

US 2014/0317956 A1 Oct. 30, 2014

(51) Int. Cl.

| | |
|---|---|
| ***A43C 15/16*** | (2006.01) |
| ***A43D 100/00*** | (2006.01) |
| ***A43B 5/14*** | (2006.01) |
| ***A43D 1/08*** | (2006.01) |

(52) U.S. Cl.

CPC ..... *A43C 15/161* (2013.01); *A43B 5/14* (2013.01); *A43D 1/08* (2013.01); *A43D 100/00* (2013.01)

(58) Field of Classification Search

CPC ..... A43C 15/16; A43C 15/161; A43D 5/10; A43D 100/00; A43D 5/02; A43D 19/00; A43B 5/14; A43B 5/00; A43B 15/161

USPC ..... 36/115, 118.1, 118.5, 131, 134; 12/123; 33/515, 3

See application file for complete search history.

(56) References Cited

U.S. PATENT DOCUMENTS 5,946,754 A * 9/1999 Baldini ..... B62M 3/086 12/123
2010/0307030 A1 12/2010 Tafaute et al.
2013/0318763 A1* 12/2013 Aoki et al. ..... 29/407.01
2013/0318805 A1* 12/2013 Aoki et al. ..... 33/515
2013/0333124 A1* 12/2013 Okamoto et al. ..... 12/123
2014/0026334 A1* 1/2014 Shelley ..... A43D 5/00 12/103

FOREIGN PATENT DOCUMENTS

FR 2940020 A1 6/2010
IT WO 2005025974 A1 * 3/2005 ..... A43B 5/14
WO 2005/025974 A1 3/2005

OTHER PUBLICATIONS

Photograph of Mavic Ergo Cleat setting tool from http://joepapp.blogspot.com/2010/01/mavic-ergo-cleatalignment-system.html—Published Jan. 30, 2010.

Ergon Bike Ergonomics; Check you cleats; from http://www.ergon-bike.com/us/en/blog/; Feb. 2012; Ergon USA.

* cited by examiner

*Primary Examiner* — Robert J Hicks

*Assistant Examiner* — Heather Mangine

(74) *Attorney, Agent, or Firm* — Global IP Counselors

(57) ABSTRACT

A bicycle cleat positioning kit includes a first section and a second section. The first section has a first shoe attachment portion that is configured to be detachably coupled to a first bicycle shoe. The first section being configured to adjustably position a first cleat on a first sole of the first bicycle shoe. The second section has a second shoe attachment portion that is configured to be detachably coupled to a second bicycle shoe different from the first bicycle shoe. The second section being configured to adjustably position a second cleat on a second sole of the second bicycle shoe.

21 Claims, 20 Drawing Sheets

BICYCLE CLEAT POSITIONING KIT

BACKGROUND

1. Field of the Invention

This invention generally relates to a bicycle cleat positioning kit. More specifically, the present invention relates to a bicycle cleat positioning kit for a cleat of a bicycle shoe.

2. Background Information

Bicycling is becoming an increasingly more popular form of recreation as well as a means of transportation. Moreover, bicycling has become a very popular competitive sport for both amateurs and professionals. Whether the bicycle is used for recreation, transportation or competition, the bicycle industry is constantly improving the various components of the bicycle.

Pedals are an essential bicycle component in that they transfer cycling power to the bicycle's drive train. Different styles of bicycles utilize different bicycle pedal styles that are designed for a specific purpose such as for pleasure, off road biking, road racing, etc. In recent years, step-in or clipless pedals have gained more popularity. The step-in or clipless pedal releasably engages a cleat secured to the sole of a rider's bicycle shoe. In other words, the cleats are attached to the soles of bicycle shoes. The cleats lock the rider's feet into pedals of bicycle. More specifically, the cleats lock the rider's feet position and the rider's feet angle with respect to the pedals of the bicycle.

SUMMARY

For the sake of rider's comfort and cycling performance while riding the bicycle, the cleats need to be properly adjusted with respect to the soles of the bicycle shoes. In particular, it has been discovered that, for efficiently transferring cycling power to the pedals, the cleats need to be adequately positioned with respect to the rider's feet.

One object of the present disclosure is to provide a bicycle cleat positioning kit with which a cleat can be properly adjusted with respect to a rider's foot.

In accordance with a first aspect of the present invention, a bicycle cleat positioning kit is provided that basically includes a first section and a second section. The first section has a first shoe attachment portion that is configured to be detachably coupled to a first bicycle shoe. The first section is configured to adjustably position a first cleat on a first sole of the first bicycle shoe. The second section has a second shoe attachment portion that is configured to be detachably coupled to a second bicycle shoe different from the first bicycle shoe. The second section is configured to adjustably position a second cleat on a second sole of the second bicycle shoe.

In accordance with a second aspect of the present invention, the bicycle cleat positioning kit according to the first aspect is configured so that the first and second sections further include first and second cleat engagement portions, respectively. The first and second cleat engagement portions are configured to be detachably coupled to the first and second cleats, respectively.

In accordance with a third aspect of the present invention, the bicycle cleat positioning kit according to the second aspect is configured so that the first and second cleat engagement portions are movably arranged with respect to the first and second shoe attachment portions, respectively.

In accordance with a fourth aspect of the present invention, the bicycle cleat positioning kit according to the third aspect is configured so that the first cleat engagement portion is movable with the first cleat with respect to the first bicycle shoe while the first cleat is adjustably coupled to the first bicycle shoe. The second cleat engagement portion is movable with the second cleat with respect to the second bicycle shoe while the second cleat is adjustably coupled to the second bicycle shoe.

In accordance with a fifth aspect of the present invention, the bicycle cleat positioning kit according to the second aspect is configured so that the first cleat engagement portion is movable with the first cleat with respect to the first bicycle shoe while the first shoe attachment portion is stationary with respect to the first bicycle shoe.

The second cleat engagement portion is movable with the second cleat with respect to the second bicycle shoe while the second shoe attachment portion is stationary with respect to the second bicycle shoe.

In accordance with a sixth aspect of the present invention, the bicycle cleat positioning kit according to the second aspect is configured so that at least one of the first and second cleat engagement portions has an aperture within which corresponding one of the first and second cleats is configured to be fittedly disposed.

In accordance with a seventh aspect of the present invention, the bicycle cleat positioning kit according to the second aspect is configured so that at least one of the first and second cleat engagement portions has a clamping part that is configured to be engaged with an outer periphery of corresponding one of the first and second cleats.

In accordance with an eighth aspect of the present invention, the bicycle cleat positioning kit according to the first aspect is configured so that at least one of the first and second shoe attachment portions includes an engagement structure that is configured to be engaged with a cleat attachment portion of corresponding one of the first and second bicycle shoes.

In accordance with a ninth aspect of the present invention, the bicycle cleat positioning kit according to the eighth aspect is configured so that the engagement structure has a screw part that is threadedly coupled to a screw hole of the cleat attachment portion.

In accordance with a tenth aspect of the present invention, the bicycle cleat positioning kit according to the eighth aspect is configured so that the engagement structure has a protruding part that mates with a recess of the cleat attachment portion.

In accordance with an eleventh aspect of the present invention, the bicycle cleat positioning kit according to the first aspect further includes a cleat adjustment member. The cleat adjustment member has a first coupling portion that is selectively coupled to the first cleat engagement portion while the first cleat is adjustably coupled to the first bicycle shoe, and a second coupling portion that is selectively coupled to the second cleat engagement portion while the second cleat is adjustably coupled to the second bicycle shoe.

In accordance with a twelfth aspect of the present invention, the bicycle cleat positioning kit according to the eleventh aspect is configured so that the cleat adjustment member is movably arranged with respect to the first shoe attachment portion while the cleat adjustment member is coupled to the first cleat engagement portion. The cleat adjustment member is movably arranged with respect to the second shoe attachment portion while the cleat adjustment member is coupled to the second cleat engagement portion.

In accordance with a thirteenth aspect of the present invention, the bicycle cleat positioning kit according to the twelfth aspect is configured so that the cleat adjustment member is movable with the first cleat with respect to the first bicycle shoe while the first cleat is adjustably coupled to the first bicycle shoe. The cleat adjustment member is movable with the second cleat with respect to the second bicycle shoe while the second cleat is adjustably coupled to the second bicycle shoe.

In accordance with a fourteenth aspect of the present invention, the bicycle cleat positioning kit according to the thirteenth aspect is configured so that the cleat adjustment member is adjustable relative to a first reference position on the first bicycle shoe while the first cleat is adjustably coupled to the first bicycle shoe. The cleat adjustment member is adjustable relative to a second reference position on the second bicycle shoe while the second cleat is adjustably coupled to the second bicycle shoe.

In accordance with a fifteenth aspect of the present invention, the bicycle cleat positioning kit according to the second aspect is configured so that the first and second shoe attachment portions have first and second shoe reference indicators with respect to the first and second bicycle shoes, respectively. The first and second cleat engagement portions have first and second cleat adjusting indicators, respectively. The first and second cleat adjusting indicators are indicative of adjustment amounts of the first and second cleats with respect to the first and second shoe reference indicators, respectively.

In accordance with a sixteenth aspect of the present invention, the bicycle cleat positioning kit according to the second aspect further includes a retainer movable with respect to the first and second sections. The retainer is arranged to relatively retain the first shoe attachment portion with respect to the first cleat engagement portion while the first cleat is adjustably coupled to the first bicycle shoe. The retainer is arranged to relatively retain the second shoe attachment portion with respect to the second cleat engagement portion while the second cleat is adjustably coupled to the second bicycle shoe.

In accordance with a seventeenth aspect of the present invention, the bicycle cleat positioning kit according to the second aspect is configured so that the first cleat engagement portion of the first section and the second shoe attachment portion of the second section are integrally formed as a one-piece, unitary member.

In accordance with an eighteenth aspect of the present invention, the bicycle cleat positioning kit according to the seventeenth aspect is configured so that the first shoe attachment portion is independently formed as a separate member from the first cleat engagement portion and the second shoe attachment portion. The second cleat engagement portion is independently formed as a separate member from the first cleat engagement portion and the second shoe attachment portion.

In accordance with a nineteenth aspect of the present invention, the bicycle cleat positioning kit according to the eighteenth aspect is configured so that at least a part of the first shoe attachment portion is overlaid on the first cleat engagement portion while the first shoe attachment portion is attached to the first bicycle shoe and the first cleat engagement portion is attached to the first cleat. At least a part of the second cleat engagement portion is overlaid on the second shoe attachment portion while the second shoe attachment portion is attached to the second bicycle shoe and the second cleat engagement portion is attached to the second cleat.

These and other objects, features, aspects and advantages will become apparent to those skilled in the art from the following detailed description, which, taken in conjunction with the annexed drawings, discloses selected embodiments.

BRIEF DESCRIPTION OF THE DRAWINGS

Referring now to the attached drawings which form a part of this original disclosure.

DETAILED DESCRIPTION OF EMBODIMENTS

Selected embodiments will now be explained with reference to the drawings. It will be apparent to those skilled in the art from this disclosure that the following descriptions of the embodiments are provided for illustration only and not for the purpose of limiting the invention as defined by the appended claims and their equivalents.

Figure 1:
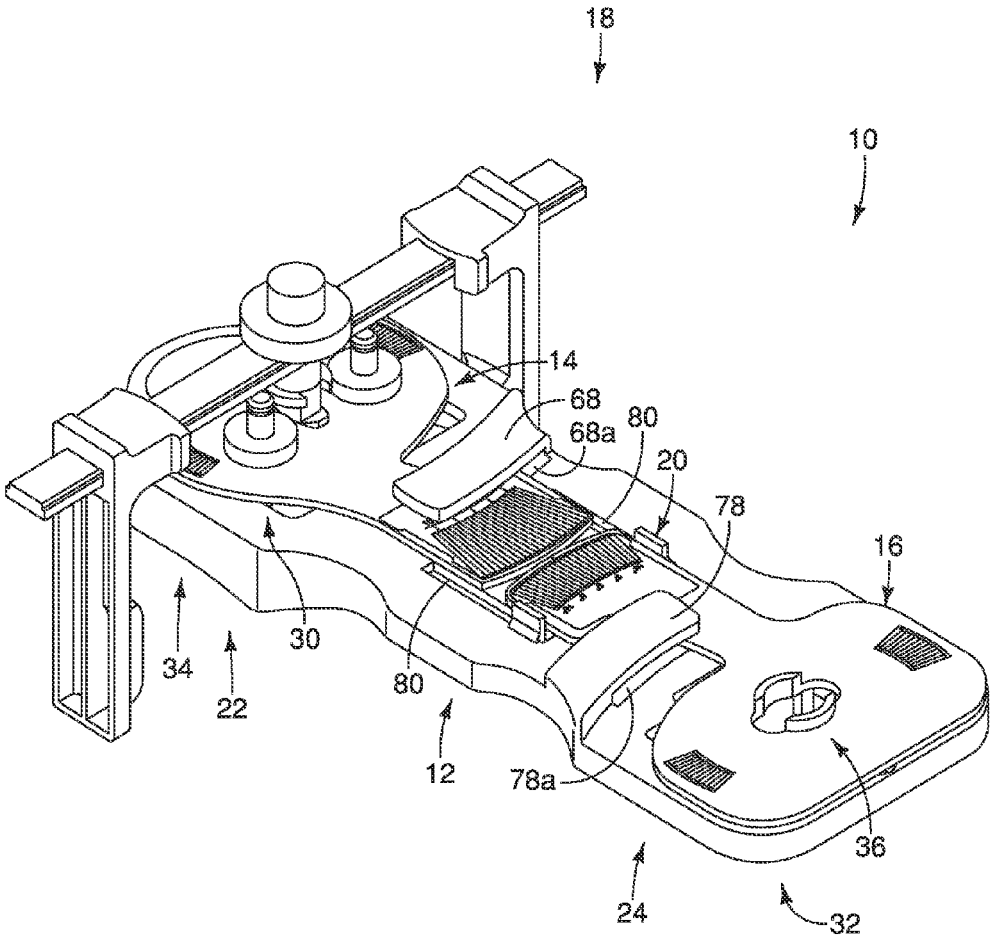
FIG. 1 is a perspective view of a bicycle cleat positioning kit in accordance with a first embodiment, with all of the parts of the bicycle cleat positioning kit assembled together.
Figure 2:
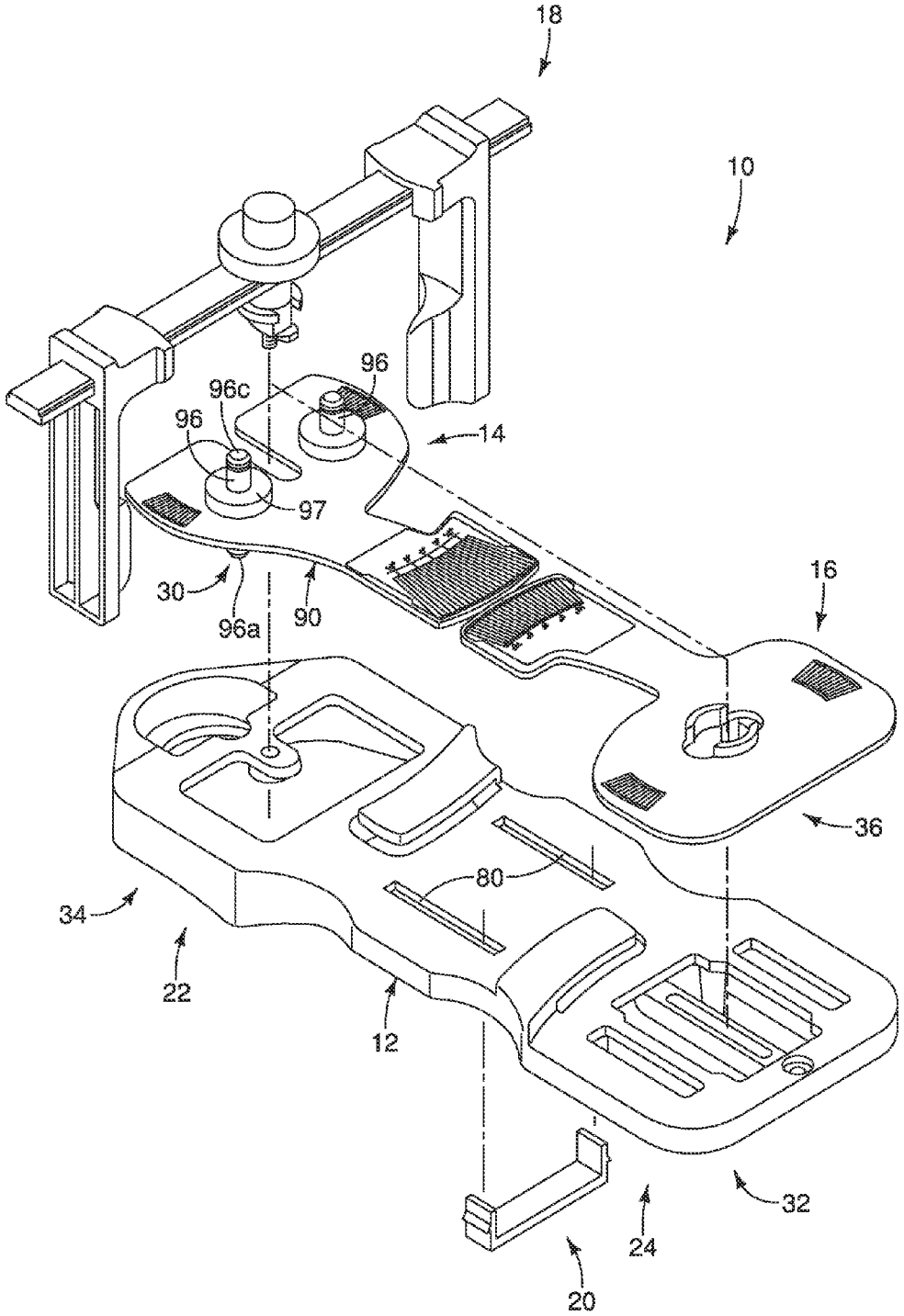
FIG. 2 is an exploded perspective view of the bicycle cleat positioning kit illustrated in FIG. 1.

Referring initially to FIGS. 1 and 2, a bicycle cleat positioning kit 10 is illustrated in accordance with one embodiment. The bicycle cleat positioning kit 10 is basically usable for attaching a bicycle cleat to a recommended position of a bicycle shoe. Alternatively or optionally, the bicycle cleat positioning kit 10 is usable for measuring a cleat mounting position of the bicycle cleat with respect to the bicycle shoe. Furthermore, the bicycle cleat positioning kit 10 is usable for fine-tuning the cleat mounting position of the bicycle cleat with respect to the measured position, or for attaching the bicycle cleat to the same measured position. The bicycle cleat positioning kit 10 is usable for a plurality of different types of bicycle cleats. In the illustrated embodiment, the bicycle cleat positioning kit 10 is usable for two different types of bicycle cleats as described in detail later.

As shown in FIGS. 1 and 2, the bicycle cleat positioning kit 10 basically includes a main plate or cleat holder 12, a first scale plate 14, and a second scale plate 16. The bicycle cleat positioning kit 10 also includes a cleat adjustment member 18. The bicycle cleat positioning kit 10 also includes a retainer 20.

In the illustrated embodiment, the bicycle cleat positioning kit 10 has two functionally different sections. Specifically, the bicycle cleat positioning kit 10 has a first section 22 and a second section 24. In the illustrated embodiment, as shown in FIG. 2, the first and second sections 22 and 24 have first and second shoe attachment portions 30 and 32, respectively. Furthermore, the first and second sections 22 and 24 have first and second cleat engagement portions 34 and 36, respectively. In the illustrated embodiment, as shown in FIG. 2, the first shoe attachment portion 30 is formed by a part of the first scale plate 14 while the first cleat engagement portion 34 is formed by a part of the main plate 12. Furthermore, as shown in FIG. 2, the second shoe attachment portion 32 is formed by a part of the main plate 12 while the second cleat engagement portion 36 is formed by a part of the second scale plate 16. The first and second scale plates 14 and 16 are independently formed as separate members from the main plate 12. In other words, in the illustrated embodiment, the first cleat engagement portion 34 of the first section 22 and the second shoe attachment portion 32 of the second section 24 are integrally formed as a one-piece, unitary member. The first shoe attachment portion 30 of the first section 22 is independently formed as a separate member from the first cleat engagement portion 34 and the second shoe attachment portion 32. The second cleat engagement portion 36 is independently formed as a separate member from the first cleat engagement portion 34 and the second shoe attachment portion 32. The configurations of the main plate 12, and the first and second scale plates 14 and 16 will be described in detail later.

Figure 3:
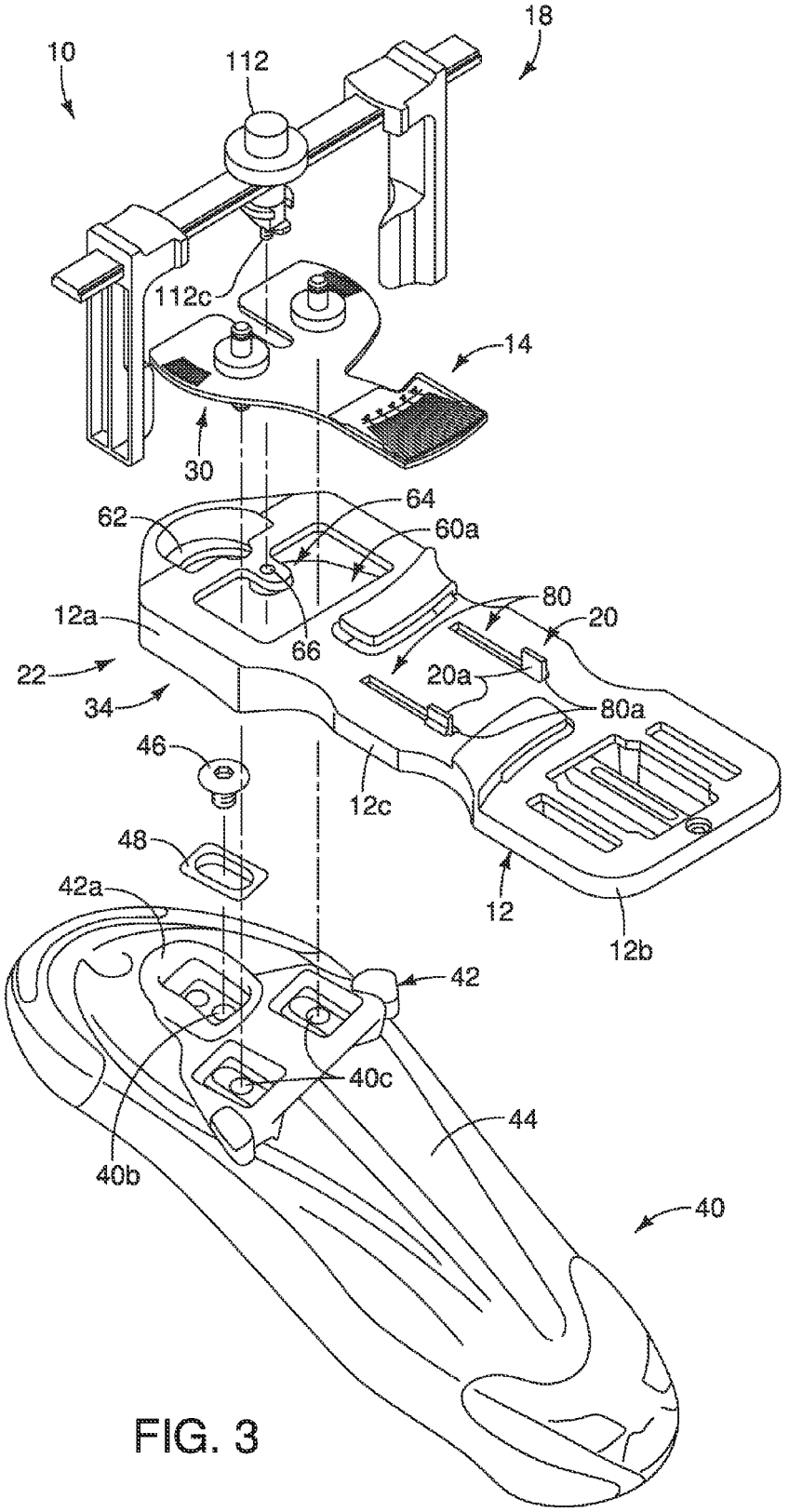
FIG. 3 is an exploded perspective view of the bicycle cleat positioning kit illustrated in FIG. 1, illustrating an adjustment assembly of the bicycle cleat positioning kit attached to a shoe sole of a road bike shoe.
Figure 4:
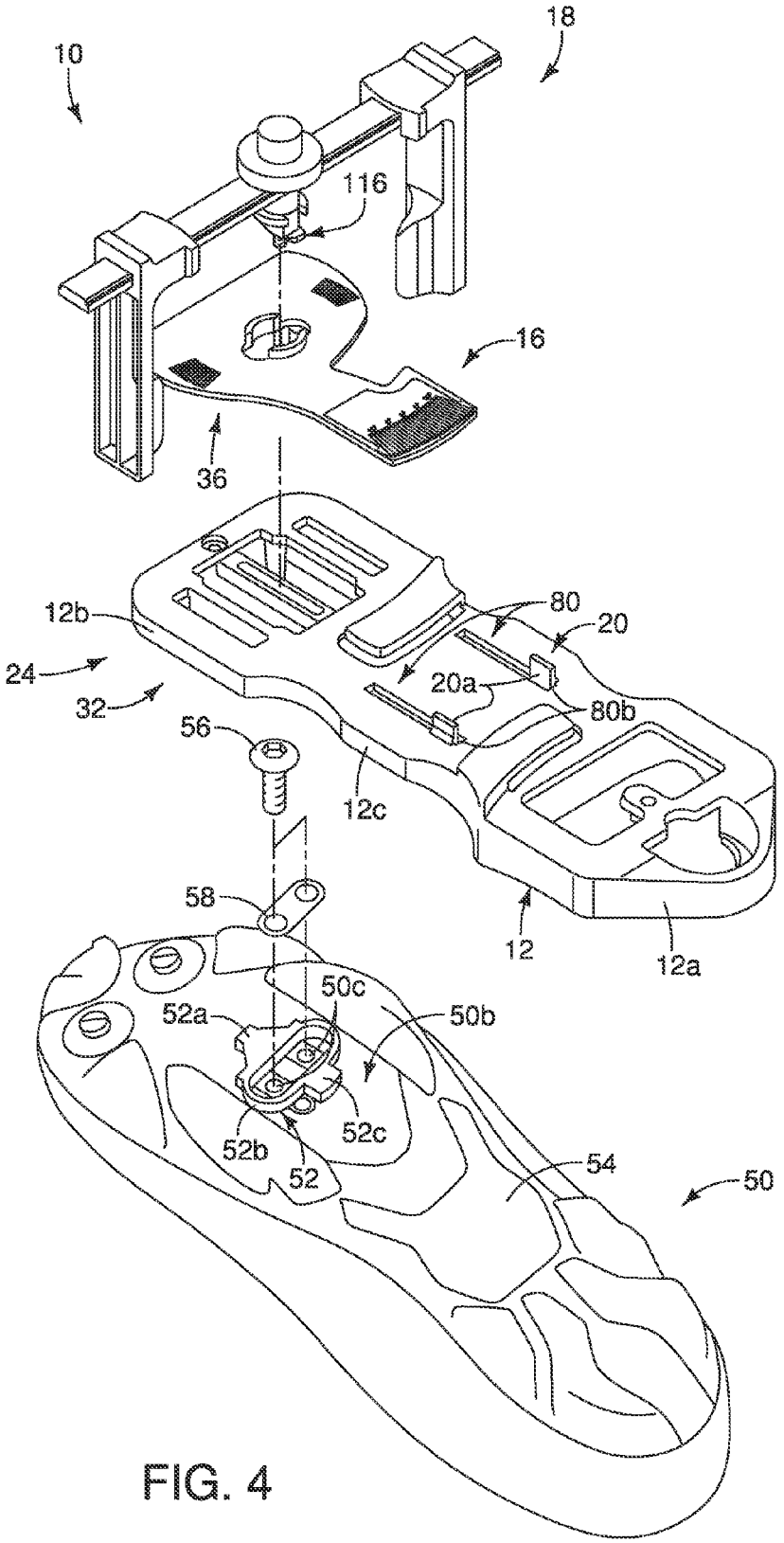
FIG. 4 is an exploded perspective view of the bicycle cleat positioning kit illustrated in FIG. 1, illustrating another adjustment assembly of the bicycle cleat positioning kit attached to a shoe sole of a mountain bike shoe.

As illustrated in FIGS. 3 and 4, the first and second sections 22 and 24 of the bicycle cleat positioning kit 10 are selectively used for two different types of bicycle cleats, respectively. In particular, as shown in FIG. 3, the first section 22 is used for a first bicycle shoe 40. Specifically, the first section 22 is configured to adjustably position a first cleat 42 on a first sole 44 of the first bicycle shoe 40. On the other hand, as shown in FIG. 4, the second section 24 is used for a second bicycle shoe 50 different from the first bicycle shoe 40. Specifically, the second section 24 is configured to adjustably position a second cleat 52 on a second sole 54 of the second bicycle shoe 50. In the illustrated embodiment, the first bicycle shoe 40 is illustrated as a road bike shoe and the second bicycle shoe 50 is illustrated as a mountain bike shoe. Furthermore, the first cleat 42 is illustrated as a road bike cleat, such as SPD-SL, and the second bicycle shoe 50 is illustrated as a mountain bike cleat, such as SPD.

As shown in FIG. 3, for adjusting the first cleat 42 with respect to the first bicycle shoe 40, the main plate 12, the first scale plate 14, and the cleat adjustment member 18 are overlaid on the first sole 44 of the first bicycle shoe 40 in this order. In the illustrated embodiment, the first shoe attachment portion 30 of the first section 22 is configured to be detachably coupled to the first bicycle shoe 40. The first cleat engagement portion 34 is configured to be detachably coupled to the first cleat 42. The first cleat 42 is temporarily and adjustably coupled to the first sole 44 of the first bicycle shoe 40 before the main plate 12, the first scale plate 14, and the cleat adjustment member 18 are attached to the first bicycle shoe 40. When the first cleat 42 is temporarily coupled to the first sole 44 of the first bicycle shoe 40, a cleat mounting bolt 46 is not fully tightened to a toe-side screw hole 40*b* of the first sole 44. The cleat mounting bolt 46 is disposed through an elongated hole of a cleat washer 48 that is placed on a recessed seat of the first cleat 42, and threaded into the screw hole 40*b* of the first bicycle shoe 40. The configuration of the first bicycle shoe 40 with the first cleat 42 is conventional. Thus, detailed description of the first bicycle shoe 40 will be omitted for the sake of brevity.

On the other hand, as shown in FIG. 4, for adjusting the second cleat 52 with respect to the second bicycle shoe 50, the main plate 12, the second scale plate 16, and the cleat adjustment member 18 are overlaid on the second sole 54 of the second bicycle shoe 50 in this order. The second shoe attachment portion 32 of the second section 24 is configured to be detachably coupled to the second bicycle shoe 50 different from the first bicycle shoe 40. The second cleat engagement portion 36 is configured to be detachably coupled to the second cleat 52. The second cleat 52 is temporarily and adjustably coupled to the second sole 54 of the second bicycle shoe 50 within a recess 50*b* of the second sole 54 before the main plate 12, the second scale plate 16, and the cleat adjustment member 18 are attached to the second bicycle shoe 50. When the second cleat 52 is temporarily coupled to the second sole 54 of the second bicycle shoe 50, a pair of cleat mounting bolts 56 (only one is shown in FIG. 4) is not fully tightened to a pair of screw holes 50*c* of the second sole 54. The cleat mounting bolts 56 are disposed through holes of a cleat washer 58 that is placed on a recessed seat of the second cleat 52, and threaded into the screw holes 50*c* of the second bicycle shoe 50. The configuration of the second bicycle shoe 50 with the second cleat 52 is conventional. Thus, detailed description of the second bicycle shoe 50 will be omitted for the sake of brevity.

In the illustrated embodiment, only left side shoes are illustrated in FIGS. 3 and 4. However, of course, the bicycle cleat positioning kit 10 can be applied to right side shoes in the same manner as described below for the left side shoes. Therefore, in the illustrated embodiment, the following disclosure will focus on the application of the bicycle cleat positioning kit 10 to the left side shoes for the sake of brevity.

Figure 5:
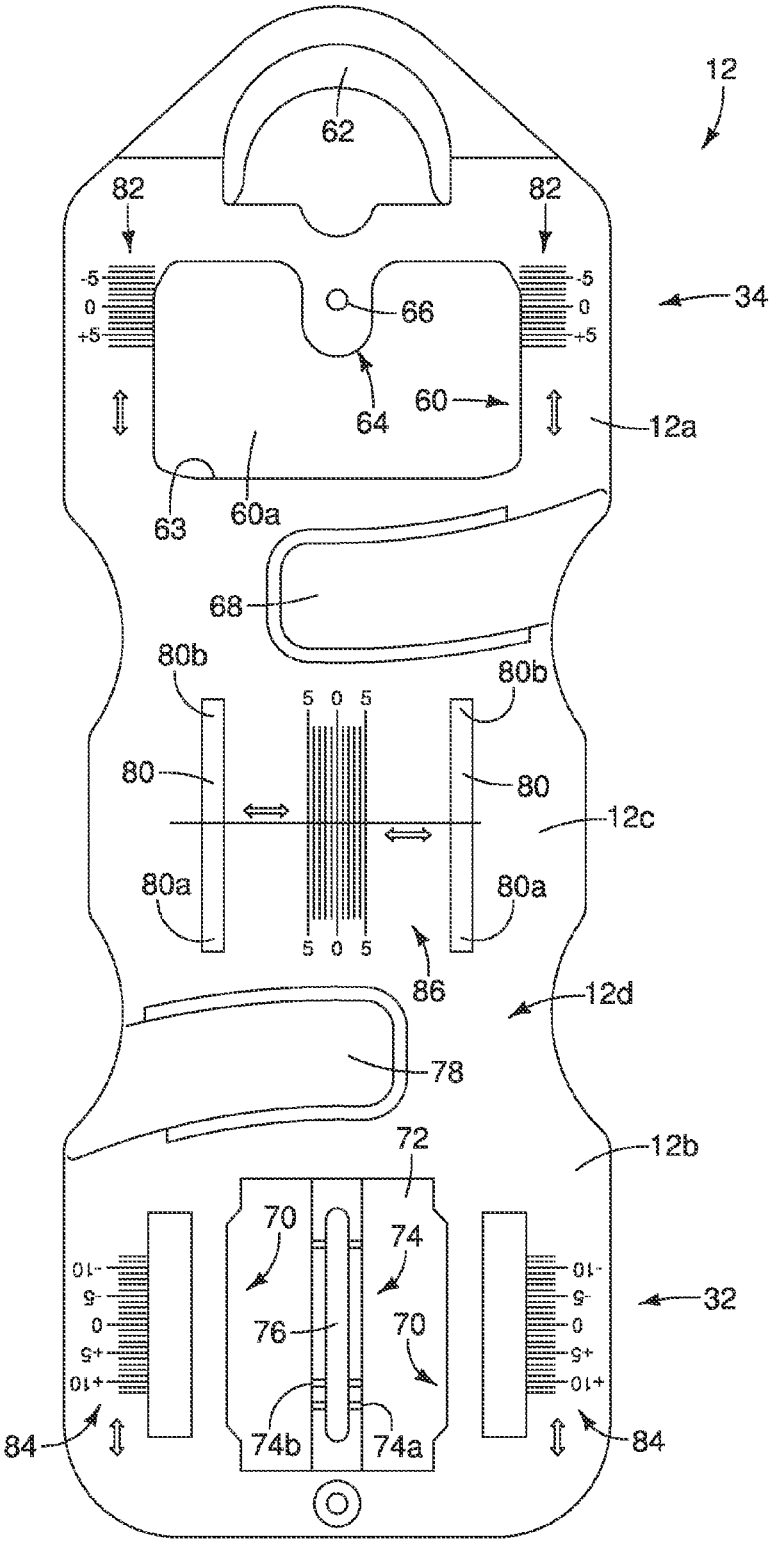
FIG. 5 is a top plan view of a main plate of the bicycle cleat positioning kit illustrated in FIG. 1.
Figure 6:
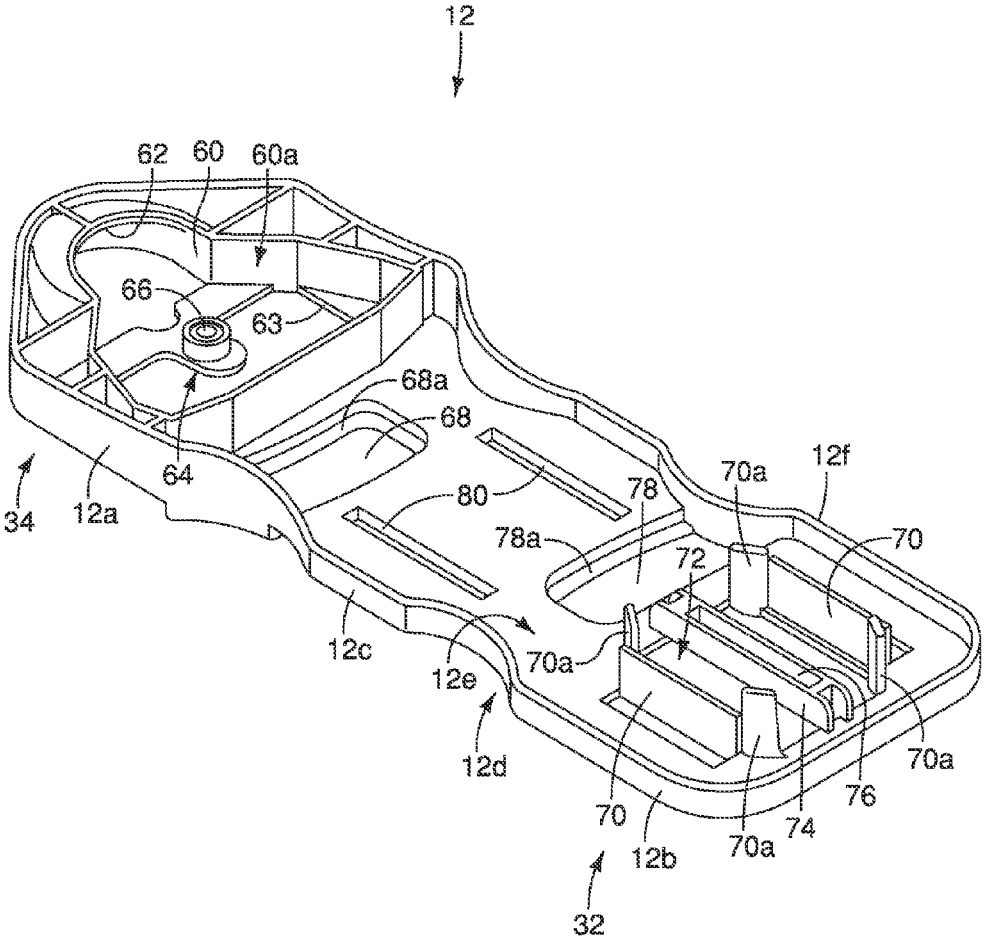
FIG. 6 is a bottom perspective view of the main plate illustrated in FIG. 5.

Referring to FIGS. 5 to 11, each of the components of the bicycle cleat positioning kit 10 will be described in detail. As illustrated in FIGS. 5 and 6, the main plate 12 basically includes a first end part 12*a*, a second end part 12*b* and a middle part 12*c*. The first end part 12*a* has the first cleat engagement portion 34 of the first section 22 The second end part 12*b* has the second shoe attachment portion 32 of the second section 24 The middle part 12*c* is disposed between the first and second end parts 12*a* and 12*b*. In other words, the first cleat engagement portion 34 and the second shoe attachment portion 32 are arranged relative to each other along a lengthwise direction of the main plate 12. The main plate 12 is formed of a rigid plate-shape member. In particular, the main plate 12 is made of a rigid plastic material or any other suitable material. The main plate 12 is integrally formed as a one-piece, unitary member. Thus, the first cleat engagement portion 34 of the first section 22 and the second shoe attachment portion 32 of the second section 24 are integrally formed as a one-piece, unitary member.

As shown in FIGS. 5 and 6, in the first end part 12*a* of the main plate 12, the first cleat engagement portion 34 has an inner peripheral surface 60 defining an aperture 60*a* therewithin. As best shown in FIG. 6, the inner peripheral surface 60 has an inner profile that corresponds to an outer profile of the first cleat 42 (see FIG. 3) such that the first cleat 42 fittedly mates with the first cleat engagement portion 34 within the aperture 60*a*. In other words, in the illustrated embodiment, the first cleat engagement portion 34 (e.g., at least one of the first and second cleat engagement portions 34 and 36) has the aperture 60*a* within which the first cleat 42 (e.g., corresponding one of the first and second cleats 42 and 52) is configured to be fittedly disposed. In the first end part 12*a* of the main plate 12, the first cleat engagement portion 34 further has a step portion 62 extending inward of the aperture 60*a* from a narrow end portion of the inner peripheral surface 60. The step portion 62 is engaged with a front flange part 42*a* of the first cleat 42 (see FIG. 3) while the first cleat engagement portion 34 is engaged with the first cleat 42 such that the first cleat 42 is disposed within the aperture 60*a*.

Furthermore, as shown in FIGS. 5 and 6, the first end part 12*a* of the main plate 12 has a window portion 63, a coupling portion 64 with a screw hole 66 and a retaining tab 68. The window portion 63 is formed on a top surface 12*d* of the main plate 12 such that the window portion 63 communicates with the aperture 60*a* to define a through opening of the main plate 12. As shown in FIG. 1, the first shoe attachment portion 30 of the first scale plate 14 is disposed through this through opening of the main plate 12 while the first scale plate 14 is attached to the main plate 12. The detailed configuration of the first scale plate 14 will be described in detail later. The coupling portion 64 is detachably coupled to the cleat adjustment member 18. In particular, the cleat adjustment member 18 is threadedly coupled to the screw hole 66 of the coupling portion 64. In the illustrated embodiment, a nut having the screw hole 66 is embedded in the coupling portion 64. However, the screw hole 66 can be formed by cutting a thread in the coupling portion 64. The retaining tab 68 extends from a side edge portion of the first end part 12*a* of the main plate 12 in a cantilevered manner. As best shown in FIG. 6, the retaining tab 68 defines a gap 68*a* between a top surface 12*d* of the main plate 12 and a rear surface of the retainer tab 68. As shown in FIG. 1, the first scale plate 14 is disposed in the gap 68*a* while the first scale plate 14 is attached to the main plate 12. In other words, the first scale plate 14 is partially sandwiched between the top surface 12*d* of the main plate 12 and the rear surface of the retaining tab 68, thereby preventing the first scale plate 14 from warping away from the main plate 12.

As shown in FIGS. 5 and 6, in the second end part 12*b* of the main plate 12, the second shoe attachment portion 32 has a pair of protruding parts 70 (e.g., engagement structures) on a rear surface 12*e* of the main plate 12. As shown in FIG. 6, the protruding parts 70 extend perpendicularly from the rear surface 12*e* of the main plate 12. The protruding parts 70 has a height measured from the rear surface 12*e* that is larger than that of an outer rim 12*f* of the main plate 12. Thus, when the second end part 12*b* of the main plate 12 is attached to the second sole 54 of the second bicycle shoe 50, the protruding parts 70 mates with side walls of the recess 50*b* (e.g., a cleat attachment portion) of the second sole 54 without interfering with the second sole 54, thereby coupling the second end part 12*b* of the main plate 12 to the second sole 54 of the second bicycle shoe 50 so as not to relatively move in the widthwise direction of the main plate 12. In other words, in the illustrated embodiment, the second shoe attachment portion 32 (e.g., at least one of the first and second shoe attachment portions 30 and 32) includes the protruding parts 70 (e.g., engagement structures) that are configured to be engaged with the recess 50*b* (e.g., a cleat attachment portion) of the second bicycle shoe 50 (e.g., corresponding one of the first and second bicycle shoes 40 and 50). Furthermore, in the illustrated embodiment, the engagement structure has the protruding parts 70 that mate with the recess 50*b* of the cleat attachment portion. In the illustrated embodiment, the protruding parts 70 is illustrated as an example of the engagement structure of the present invention while the recess 50*b* is illustrated as an example of the cleat attachment portion of the present invention. However, the engagement structure and the cleat attachment portion can be differently configured as long as the engagement structure can be engaged with the cleat attachment portion. Furthermore, in the illustrated embodiment, as shown in FIG. 6, each of the protruding parts 70 has a pair of reinforcing protrusions 70*a* at lengthwise ends of each of the protruding parts 70. The reinforcing protrusions 70*a* have a height that is larger than that of the protruding parts 70 and substantially equal to a depth of the recess 50*b* relative to a surface of the second sole 54, Thus, when the second end part 12*b* is attached to the second sole 54 of the second bicycle shoe 50, the reinforcing protrusions 70*a* contact with a bottom of the recess 50*b* of the second sole 54 and support the second end part 12*b* of the main plate 12 relative to the second sole 54.

Furthermore, the second end part 12*b* of the main plate 12 has a window portion 72, a supporting beam 74 with an oval opening 76 and a retaining tab 78. The window portion 72 is formed on the top surface 12*d* of the main plate 12 such that the window portion 72 defines a through opening of the main plate 12. As shown in FIGS. 1 and 2, the second cleat engagement portion 36 of the second scale plate 16 is disposed through this through opening of the main plate 12 while the second scale plate 16 is attached to the main plate 12. The detailed configuration of the second scale plate 16 will be described in detail later. The supporting beam 74 extends in the lengthwise direction of the main plate 12 across the window portion 72. The supporting beam 74 supports the cleat adjustment member 18 while the cleat adjustment member 18 is attached to the second cleat engagement portion 36 of the second scale plate 16. A part of the cleat adjustment member 18 (e.g., a screw section 112*c* in FIG. 10) is disposed within the oval opening 76 to prevent the supporting beam 74 from interfering with the part of the cleat adjustment member 18 while the cleat adjustment member 18 is attached to the second cleat engagement portion 36. The detailed configurations of the second cleat engagement portion 36 and the cleat adjustment member 18 will be described in detail later. The retaining tab 78 extends from a side edge portion of the second end part 12*b* of the main plate 12 in a cantilevered manner. The retaining tab 78 defines a gap 78*a* between the top surface 12*d* of the main plate 12 and a rear surface of the retainer tab 78. As shown in FIG. 1, the second scale plate 16 is disposed in the gap 78*a* while the second scale plate 16 is attached to the main plate 12. In other words, the second scale plate 16 is partially sandwiched between the top surface 12*d* of the main plate 12 and the rear surface of the retaining tab 78, thereby preventing the second scale plate 16 from warping away from the main plate 12.

As shown in FIGS. 5 and 6, the middle portion 12*c* of the main plate 12 has a pair of slits 80 extending parallel to each other in the lengthwise direction of the main plate 12. The slits 80 are spaced away from each other in the widthwise direction of the main plate 12. As shown in FIGS. 1 and 2, the retainer 20 is slidably coupled to the slits 80 of the middle portion 12*c* of the main plate 12. The detailed configuration of the retainer 20 will be described in detail later.

As shown in FIG. 5, the main plate 12 further has a pair of first straight scales 82 at the first end portion 12*a*, a pair of second straight scales 84 at the second end portion 12*b*, and a third straight scale 86 at the middle portion 12*c*. Each of the first straight scales 82 has a plurality of line segments. The line segments are arranged at predetermined intervals in parallel to each other in the lengthwise direction of the main plate 12. In this embodiment, the line segments of the first straight scales 82 are arranged in the lengthwise direction at 1 mm intervals. However, the value of the predetermined intervals can be different value. Each of the second straight scales 84 has a plurality of line segments. The line segments are arranged at predetermined intervals in parallel to each other in the lengthwise direction of the main plate 12. In this embodiment, the line segments of the second straight scales 84 are arranged in the lengthwise direction at one mm intervals. However, the value of the predetermined intervals can be different value. The third straight scale 86 has a plurality of line segments. The line segments are arranged at predetermined intervals in parallel to each other in the widthwise direction of the main plate 12. In this embodiment, the line segments of the third straight scales 86 are arranged in the widthwise direction at 1 mm intervals. However, the value of the predetermined intervals can be different value. Although the main plate 12 has the first, second and third straight scales 82, 84 and 86, these scales 82, 84 and 86 of the main plate 12 are omitted in FIGS. 1 to 4, 14 and 19 for clear illustration of other elements of the bicycle cleat positioning kit 10.

Figure 7:
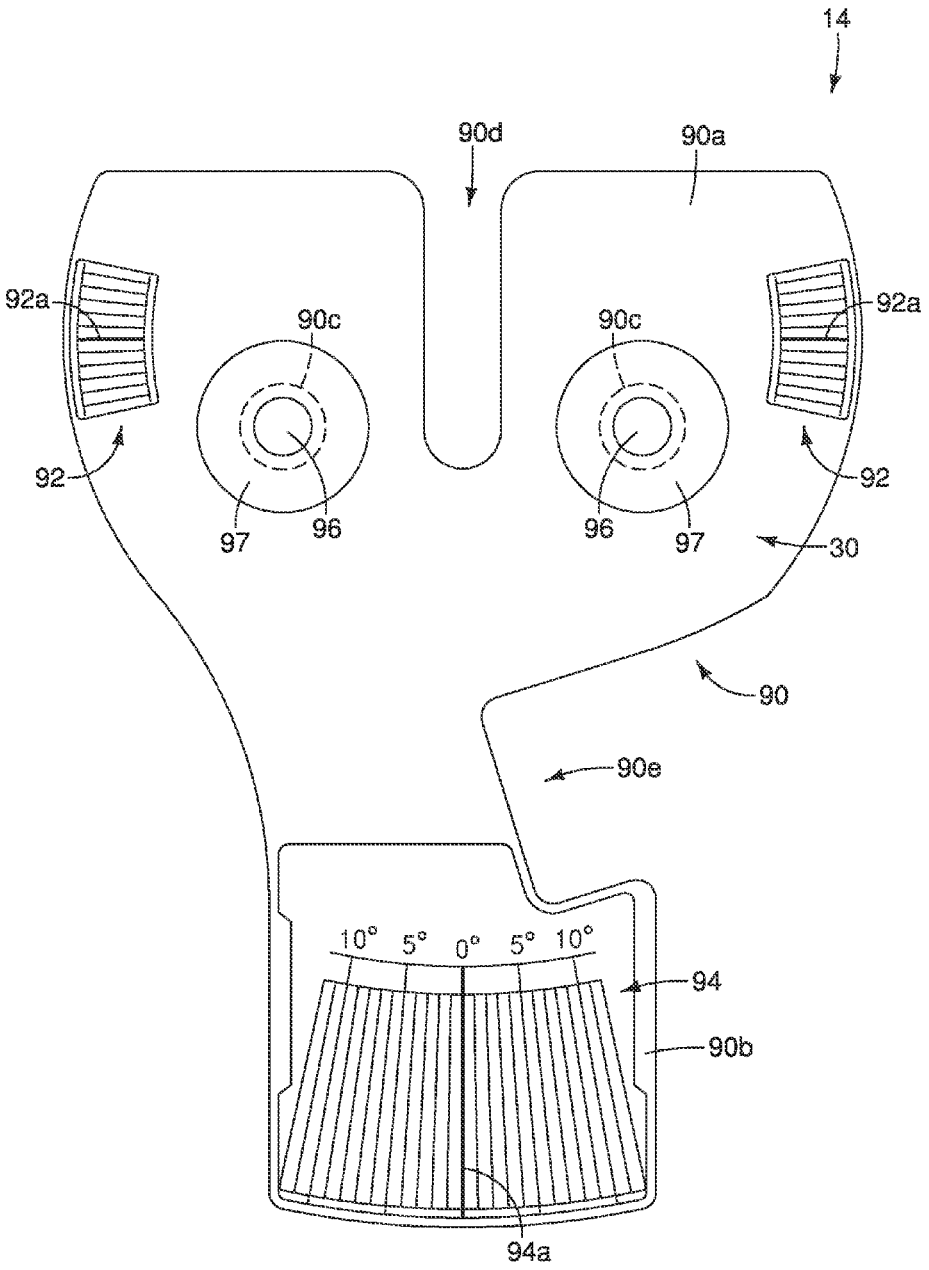
FIG. 7 is a top plan view of a first scale plate of the bicycle cleat positioning kit illustrated in FIG. 1.
Figure 8:
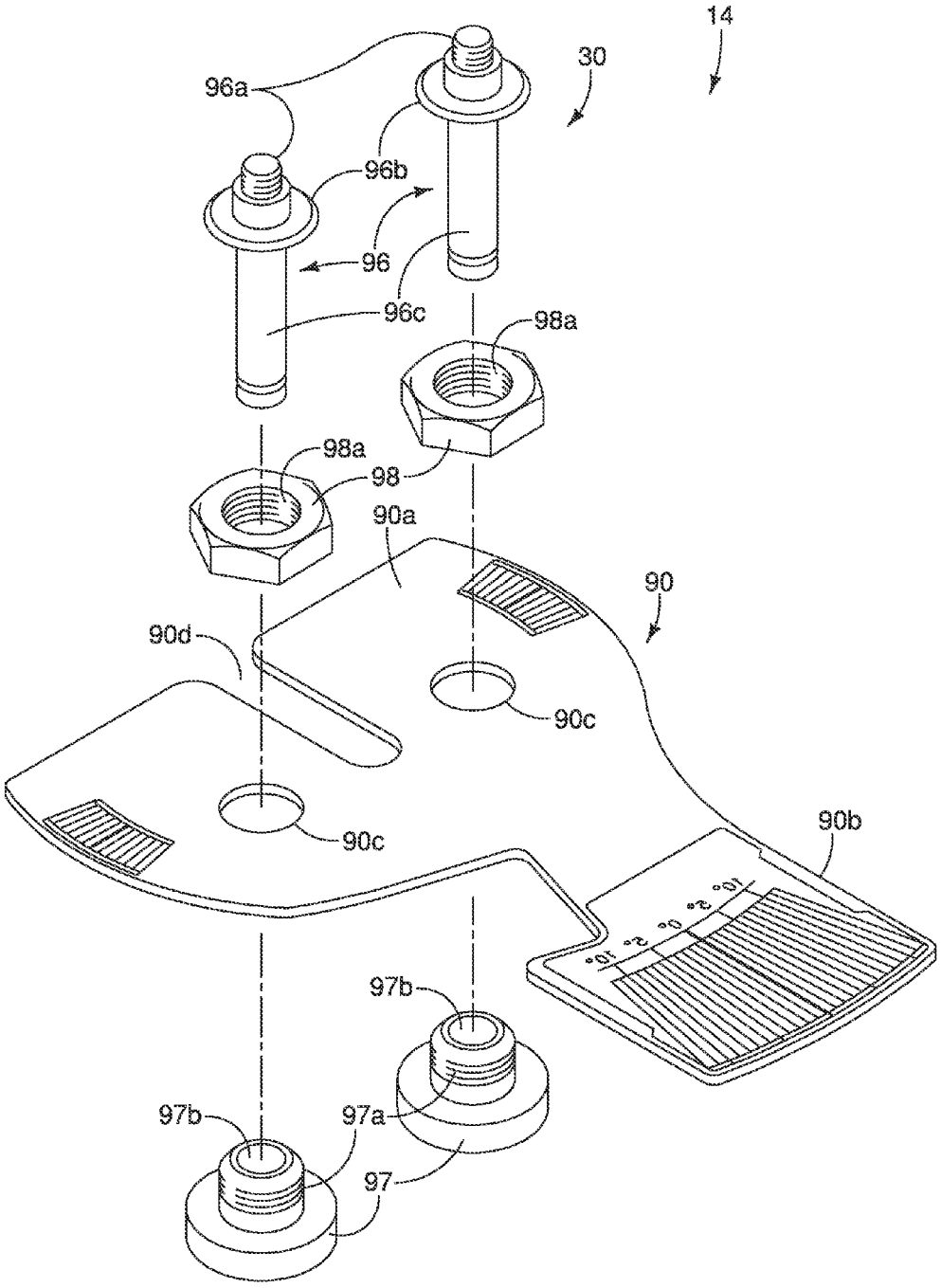
FIG. 8 is an exploded bottom perspective view of the first scale plate illustrated in FIG. 7.

Referring now to FIGS. 7 and 8, the configuration of the first scale plate 14 will be described in detail. As mentioned above, the first scale plate 14 basically has the first shoe attachment portion 30. In particular, the first scale plate 14 includes a plate body 90 to which the first shoe attachment portion 30 is provided. As shown in FIG. 7, the plate body 90 is formed of a transparent or translucent sheet member. In particular, the plate body 90 is made of a plastic material or any other suitable material. The plate body 90 is formed as a one-piece, unitary member. The plate body 90 has a pair of first angle scales 92 and a second angle scale 94. The first angle scales 92 are disposed on edge portions of a wide portion 90*a* of the plate body 90. The second angle scale 94 is disposed on a narrow portion 90*b* that extends from the wide portion 90*a* of the plate body 90. In the illustrated embodiment, the first and second angle scales 92 and 94 are printed on stickers that are attached to predetermined locations on the plate body 90 as shown in FIG. 7. Of course, the first and second angle scales 92 and 94 can be provided to the plate body 90 in different conventional manners. Each of the first angle scales 92 includes a plurality of line segments that is arranged at predetermined intervals in a rotational direction of the first scale plate 14 about a rotational center of the first scale plate 14. In this embodiment, the line segments of each of the first angle scales 92 are arranged in the rotational direction at one degree intervals. However, the value of the predetermined intervals can be different value. The line segments of each of the first angle scales 92 extend radially with respect to a reference rotational center point of the first cleat 42 while the first scale plate 14 is attached to the first bicycle shoe 40. One line segment 92*a* of the line segments of each of the first angle scales 92 represents an origin of the first angle scales 92, and extends in the widthwise direction of the first scale plate 14. Furthermore, the second angle scale 94 also includes a plurality of line segments that is arranged at predetermined intervals in the rotational direction of the first scale plate 14 about the reference rotational center of the first scale plate 14. In this embodiment, the line segments of the second angle scale 94 are arranged in the rotational direction at 1 degree intervals. However, the value of the predetermined intervals can be different value. The line segments of the second angle scale 94 extend radially with respect to the reference rotational center point of the first cleat 42 while the first scale plate 14 is attached to the first bicycle shoe 40. One line segment 94*a* of the line segments of the second angle scale 94 represents an origin of the second angle scale 94, and extends in the lengthwise direction of the first scale plate 14.

The first shoe attachment portion 30 is provided to the plate body 90. Specifically, the first shoe attachment portion 30 includes a pair of shoe attachment bolts 96 (e.g., engagement structures), a pair of annular bolts 97, and a pair of nuts 98. The annular bolts 97 have male screw parts 97*a* that are threadedly coupled to female screw parts 98*a* of the nuts 98, respectively. Specifically, the male screw parts 97*a* of the annular bolts 97 are disposed through attachment openings 90*c* of the plate body 90, respectively, and are threaded into the female screw parts 98*a* of the nuts 98, respectively. Thus, the annular bolts 97 and the nuts 98 are fixedly coupled to the plate body 90 such that edge portions of the attachment openings 90*c* of the plate body 90 are sandwiched between the annular bolts 97 and the nuts 98, respectively. The shoe attachment bolts 96 are rotatably and axially slidably disposed through center through holes 97*b* of the annular bolts 97, respectively. The shoe attachment bolts 96 have male screw parts 96*a* (e.g., screw parts) at one ends of the shoe attachment bolts 96, respectively. The screw parts 96*a* are threadedly coupled to a pair of heel-side screw holes 40*c* (e.g., cleat attachment portions) of the first bicycle shoe 40 (see FIG. 3). In other words, in the illustrated embodiment, the first shoe attachment portion 30 (e.g., at least one of the first and second shoe attachment portions 30 and 32) includes the shoe attachment bolts 96 (e.g., engagement structures) that are configured to be engaged with the screw holes 40*c* (e.g., cleat attachment portions) of the first bicycle shoe 40 (e.g., corresponding one of the first and second bicycle shoes 40 and 50). Furthermore, the shoe attachment bolts 96 (e.g., the engagement structures) have the screw parts 96*a* that are threadedly coupled to the screw holes 40*c* of the cleat attachment portion, respectively. As illustrated in FIG. 8, the shoe attachment bolts 96 further have flange parts 96*b* that prevents the shoe attachment bolts 96 from falling out of the center through holes 97*b* of the annular bolts 97, respectively. The shoe attachment bolts 96 has a length measured from the flange parts 96*b* to the other ends 96*c* that is larger than total axial thickness of assemblies of the annular bolts 97, the nuts 98 and the plate body 90. Thus, as seen in FIG. 3, both the screw parts 96*a* and the other ends 96*c* are disposed axially outside of the assemblies of the annular bolts 97, the nuts 98 and the plate body 90. When the first scale plate 14 is attached to the first bicycle shoe 40, the other ends 96*c* of the shoe attachment bolts 96 are held to rotate for threadedly couple the shoe attachment bolts 96 to the screw holes 40*c* of the first bicycle shoe 40, thereby fixedly coupling the first scale plate 14 to the first bicycle shoe 40. The shoe attachment bolts 96 can also include O-rings that are attached to circumferential grooves of the other ends 96*c*, respectively, for easily gripping the other ends 96*c* and for preventing the shoe attachment bolts 96 from falling out of the center through holes 97*b* of the annular bolts 97, respectively.

Figure 9:
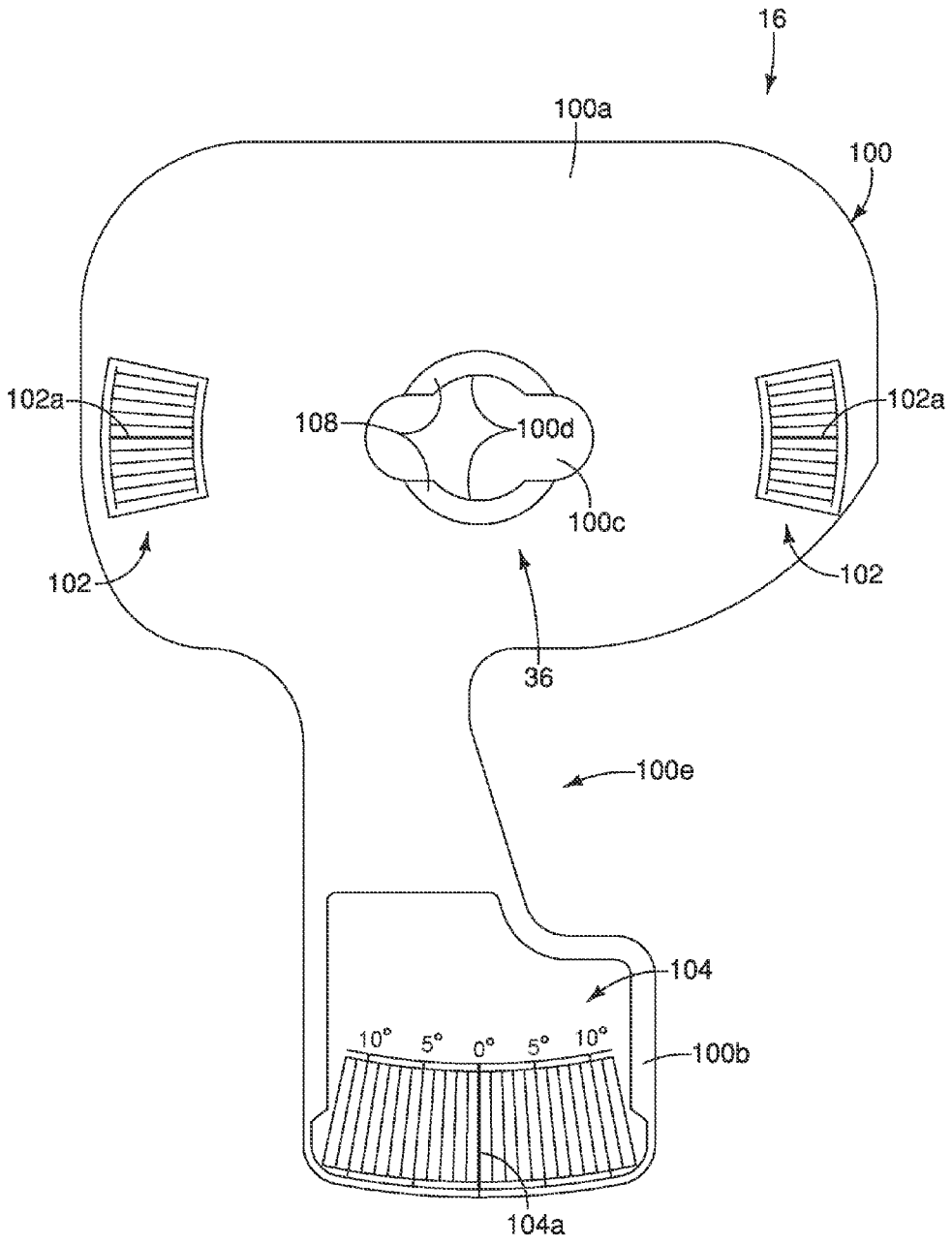
FIG. 9 is a top plan view of a second scale plate of the bicycle cleat positioning kit illustrated in FIG. 1.
Figure 10:
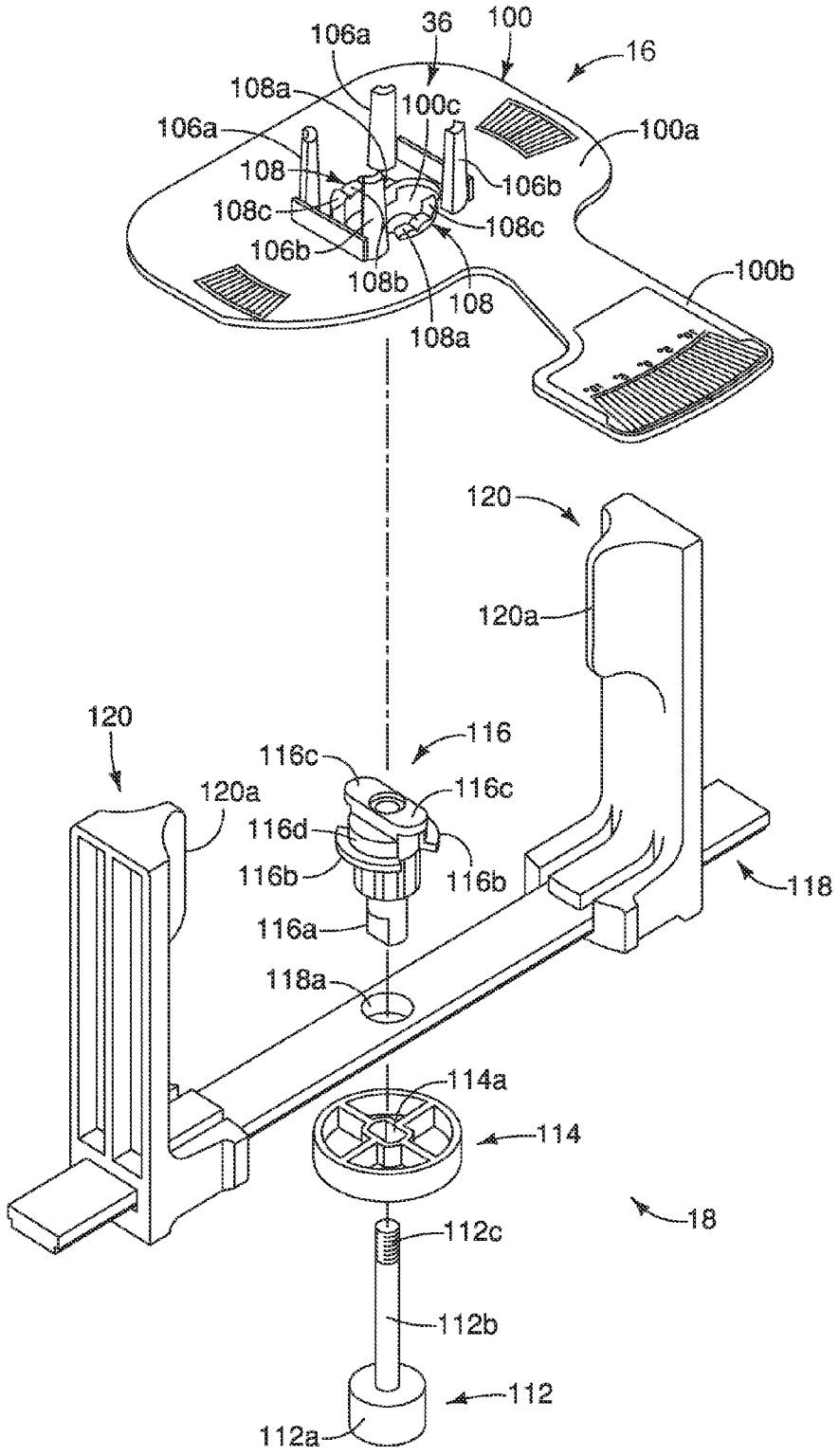
FIG. 10 is an exploded bottom perspective view of a cleat adjustment member of the bicycle cleat positioning kit illustrated in FIG. 1, the cleat adjustment member detachably coupled to the second scale plate illustrated in FIG. 9.

Referring now to FIGS. 9 and 10, the configuration of the second scale plate 16 will be described in detail. As mentioned above, the second scale plate 16 basically has the second cleat engagement portion 36. In particular, the second scale plate 16 includes a plate body 100 to which the second cleat engagement portion 36 is provided. As shown in FIGS. 9 and 10, the plate body 100 is formed of a transparent or translucent sheet member. In particular, the plate body 100 is made of a plastic material or any other suitable material. The plate body 100 is formed as a one-piece, unitary member. The plate body 100 has a pair of third angle scales 102 and a fourth angle scale 104. The third angle scales 102 are disposed on edge portions of a wide portion 100*a* of the plate body 100. The fourth angle scale 104 is disposed on a narrow portion 100*b* that extends from the wide portion 100*a* of the plate body 100. In the illustrated embodiment, the third and fourth angle scales 102 and 104 are printed on stickers that are attached to predetermined locations on the plate body 100 as shown in FIG. 9. Of course, the third and fourth angle scales 102 and 104 can be provided to the plate body 100 in different conventional manners. Each of the third angle scales 102 includes a plurality of line segments that is arranged at predetermined intervals in a rotational direction of the second scale plate 16 about a rotational center of the second scale plate 16. In this embodiment, the line segments of each of the third angle scales 102 are arranged in the rotational direction at 1 degree intervals. However, the value of the predetermined intervals can be different value. The line segments of each of the third angle scales 102 extend radially with respect to a rotational center point of the second cleat 52 while the second scale plate 16 is attached to the second cleat 52. One line segment 102*a* of the line segments of each of the third angle scales 102 represents an origin of the third angle scales 102, and extends in the widthwise direction of the second scale plate 16. Furthermore, the fourth angle scale 104 also includes a plurality of line segments that is arranged at predetermined intervals in a rotational direction of the second scale plate 16 about a rotational center of the second scale plate 16. In this embodiment, the line segments of the fourth angle scale 104 are arranged in the rotational direction at 1 degree intervals. However, the value of the predetermined intervals can be different value. The line segments of the fourth angle scale 104 extend radially with respect to the rotational center point of the second cleat 52 while the second scale plate 16 is attached to the second cleat 52. One line segment 104*a* of the line segments of the fourth angle scales 104 represents an origin of the fourth angle scales 104, and extends in the lengthwise direction of the second scale plate 16.

The second cleat engagement portion 36 is provided to a rear surface of the plate body 100. Specifically, the second cleat engagement portion 36 includes a pair of front clamping parts 106*a* and a pair of rear clamping parts 106*b*. The front and rear clamping parts 106*a* and 106*b* protrude from the rear surface of the plate body 100 about the central opening 100*c* of the plate body 100. The front and rear clamping parts 106*a* and 106*b* form clamping parts of the present application. Specifically, in the illustrated embodiment, the second cleat engagement portion 36 (e.g., at least one of the first and second cleat engagement portions 34 and 36) has the front and rear clamping parts 106*a* and 106*b* (e.g., clamping parts) that are configured to be engaged with an outer periphery of the second cleat 52 (e.g., corresponding one of the first and second cleats 42 and 52). In particular, in the illustrated embodiment, the front clamping parts 106*a* are spaced apart from each other in the widthwise direction of the second scale plate 16 by a distance corresponding to a width of a front retaining part 52*a* (FIG. 4) of the second cleat 52. In the illustrated embodiment, the width of the front retaining part 52*a* is defined as a dimension between inside corners formed between the front retaining part 52*a* of the second cleat 52 and an enlarged middle part 52*b* (FIG. 4) of the second cleat 52. Thus, when the second cleat engagement portion 36 are engaged with the second cleat 52, the front clamping parts 106*a* are fittedly engaged with the inside corners formed between the front retaining part 52*a* of the second cleat 52 and the enlarged middle part 52*b* of the second cleat 52. Furthermore, in the illustrated embodiment, the rear clamping parts 106*b* are spaced apart from each other in the widthwise direction of the second scale plate 16 by a distance corresponding to a width of a rear retaining part 52*c* (FIG. 4) of the second cleat 52. In the illustrated embodiment, the width of the rear retaining part 52*c* is defined as a dimension between inside corners formed between the rear retaining part 52*c* of the second cleat 52 and the enlarged middle part 52*b* of the second cleat 52. Thus, when the second cleat engagement portion 36 are engaged with the second cleat 52, the rear clamping parts 106*b* are fittedly engaged with the inside corners formed between the rear retaining part 52*c* of the second cleat 52 and the enlarged middle part 52*b* of the second cleat 52. Moreover, in the illustrated embodiment, the front clamping parts 106*a* and the rear clamping parts 106*b* are spaced apart from each other in the lengthwise direction of the second scale plate 16 by a distance corresponding to a dimension of the enlarged middle part 52*b* in the lengthwise direction. Thus, when the second cleat engagement portion 36 are engaged with the second cleat 52, the front and rear clamping parts 106*a* and 106*b* are fittedly engaged with the second cleat 52 so as not to relatively move in the widthwise or lengthwise directions of the second scale plate 16. However, of course, the clamping part of the present application can be differently configured as long as the clamping part fittedly engaged with an outer periphery of the second cleat 52.

The second scale plate 16 further has a pair of coupling lips 108 at front and rear edges 100*d* of the central opening 100*c* of the plate body 100 on both top and rear surfaces of the plate body 100, respectively. The coupling lips 108 are coupled with the cleat adjustment member 18 while the second cleat 52 is adjusted relative to the second bicycle shoe 50 as shown in FIG. 4. As shown in FIG. 4, the coupling lips 108 on the top surface of the plate body 100 have a constant height along the front and rear edges 100*d* of the central opening 100*c* of the plate body 100. On the other hand, as shown in FIG. 10, the coupling lips 108 on the rear surface of the plate body 100 have a height that gradually or stepwisely varies along the front and rear edges 100*d* of the central opening 100*c* of the plate body 100 about a center axis of the central opening 100*c*.

The connection between the coupling lips 108 and the cleat adjustment member 18 will be described in detail later.

Referring to FIG. 10, the configuration of the cleat adjustment member 18 will be described in detail. As shown in FIG. 10, in the illustrated embodiment, the cleat adjustment member 18 basically includes a first coupling knob 112, a second coupling knob 114, a coupling part 116, a support bar 118 and a pair of pointing parts 120.

The first coupling knob 112 extends through the second coupling knob 114, the coupling part 116, and the support bar 118, and is rotatable with respect to the second coupling knob 114, the coupling part 116, and the support bar 118. The first knob 112 has a head portion 112*a* and a rod portion 112*b* axially extending from the head portion 112*a*. In the illustrated embodiment, the first knob 112 is made of metallic material, and formed as a one-piece, unitary member. Alternatively, the first knob 112 can be made of any other rigid material, such as plastic material. The rod portion 112*b* has a screw section 112*c* at an end of the rod portion 112*b*. The screw section 112*c* is threaded into the screw hole 66 of the coupling portion 64 of the main plate 12 (FIGS. 5 and 6) when the cleat adjustment member 18 is coupled to the main plate 12.

The second coupling knob 114, the coupling part 116, the support bar 118 and the pointing parts 120 are basically made of a plastic material. However, the second coupling knob 114, the coupling part 116, the support bar 118 and the pointing parts 120 can also made of any other rigid material, such as metallic material. The second coupling knob 114 and the coupling part 116 are non-rotatably coupled to each other. The second coupling knob 114, the coupling part 116 and an attachment opening 118*a* of the support bar 118 are concentrically arranged relative to each other. Specifically, as shown in FIG. 10, an end portion 116*a* of the coupling part 116 is fittedly disposed through the attachment opening 118*a* of the support bar 118 such that the coupling part 116 is rotatably coupled to the support bar 118. Furthermore, the end portion 116*a* of the coupling part 116 is fixedly and non-rotatably coupled to an attachment hole 114*a* of the second coupling knob 114. Thus, the second coupling knob 114 and the coupling part 116 are rotatable together as a unit. Furthermore, the end portion 116*a* of the coupling part 116 is fittedly disposed through the attachment opening 118*a* of the support bar 118 to frictionally engage the coupling part 116 with the support bar 118. Thus, the second coupling knob 114 and the coupling part 116 can also be rotate with the support bar 118 while operating the support bar 118 in the rotational direction about an axial direction of the cleat adjustment member 18.

The second coupling knob 114 has a diameter that is larger than that of the head portion 112*a* of the first coupling knob 112. As shown in FIG. 10, the coupling part 116 has a center through hole through which the rod portion 112*b* of the first coupling knob 112 is rotatably disposed. The rod portion 112*b* of the first coupling knob 112 has an axial length that is larger than an axial entire dimension of the coupling part 116 such that the screw section 112*c* of the first coupling knob 112 is disposed axially outside of the coupling part 116 while the first coupling knob 112 is rotatably disposed through the coupling part 116. The coupling part 116 further has a pair of first coupling flanges 116*b*, a pair of second coupling flanges 116*c* and an intermediate portion 116*d*. The first coupling flanges 116*b* radially outwardly extend from an outer peripheral surface of the intermediate portion 116*d* at locations circumferentially spaced apart by 180 degree. In the illustrated embodiment, the first coupling flanges 116*b* circumferentially extends only partially about the outer peripheral surface of the intermediate portion 116*d*. However, alternatively, the first coupling flanges 116*b* can be circumferentially connected to each other to form a flange that extends entirely about the outer peripheral surface of the intermediate portion 116*d*. The intermediate portion 116*d* is axially disposed between the first coupling flanges 116*b* and the second coupling flanges 116*c*. The intermediate portion 116*d* has a diameter that is substantially equal or smaller than an imaginary circle connecting the front and rear edges 100*d* (FIG. 9) of the plate body 100 of the second scale plate 16. Thus, when the cleat adjustment member 18 is couple to the second scale plate 16, the intermediate portion 116*d* of the coupling part 116 is fitted between the front and rear edges 100*d* of the plate body 100 of the second scale plate 16. The second coupling flanges 116*c* radially outwardly extend from the outer peripheral surface of the intermediate portion 116*d* at locations circumferentially spaced apart by 180 degree, thereby forming an oval-shaped end portion of the coupling part 116. The second coupling flanges 116*c* are dimensioned such that the oval-shaped end portion of the coupling part 116 formed by the second coupling flanges 116*c* can be inserted into the central opening 100*c*. Thus, with the coupling part 116, once the second coupling flanges 116*c* of the coupling part 116 pass through the central opening 100*c* of the plate body 100 and the coupling part 116 is rotated relative to the plate body 100, then the second coupling flanges 116*c* of the coupling part 116 are engaged with the coupling lips 108 on the rear surface of the plate body 100. As mentioned above, as shown in FIG. 10, the coupling lips 108 on the rear surface of the plate body 100 have the height that gradually or stepwisely varies along the front and rear edges 100*d* of the central opening 100*c* of the plate body 100. Furthermore, the first and second coupling flanges 116*b* and 116*c* are axially disposed at locations axially spaced apart from each other by the distance corresponding to the thickness of the coupling lips 108 at front-most and rear-most locations of the coupling lips 108 in the lengthwise direction of the second scale plate 16. Thus, once the second coupling flanges 116*c* of the coupling part 116 is inserted through the central opening 100*c* of the plate body 100 and the coupling part 116 is rotated relative to the plate body 100 by 90 degrees in the clockwise direction of FIG. 9, then the first and second coupling flanges 116*b* and 116*c* axially and securely sandwich the coupling lips 108 of the plate body 100, thereby securely coupling the coupling part 116 to the second scale plate 16. More specifically, in the illustrated embodiment, as shown in FIG. 10, each of the coupling lips 108 has a bump portion 108*a*, a rest portion 108*b* and a stop portion 108*c* that are arranged in the counter-clockwise direction about the center axis of the central opening 100*c* of the plate body 100. The bump portion 108*a* has a height that is larger than the rest portion 108*b* while the stop portion 108*c* has a height that is larger than the bump portion 108*a*. Thus, when the coupling part 116 is rotated after being inserted through the central opening 100*c* of the plate body 100, first the second coupling flanges 116*c* ride over the bump portions 108*a* to sit on the rest portions 108*b*, respectively. When the coupling part 116 is rotated relative to the plate body 100 by 90 degrees in the counter-clockwise direction in FIG. 10, the second coupling flanges 116*c* contact with the stop portions 108*c*, thereby preventing further rotation of the coupling part 116 relative to the plate body 100. The first and second coupling flanges 116*b* and 116*c* are axially disposed at locations axially spaced apart from each other by the distance corresponding to the thickness of the coupling lips 108 at the rest portions 108*b* (i.e., front-most and rear-most locations). Thus, the first and second coupling flanges 116*b* and 116*c* axially and securely sandwich the coupling lips 108 of the plate body 100.

The pointing parts 120 are slidably coupled to the support bar 118. Specifically, as shown in FIG. 10, the pointing parts 120 are slidably attached such that pointers 120*a* of the pointing parts 120 face with respect to each other.

In the illustrated embodiment, the first coupling knob 112 forms the first coupling portion of the present invention while the coupling part 116 forms the second coupling portion of the present invention. Thus, the cleat adjustment member 18 has the first coupling knob 112 (e.g., a first coupling portion) and the coupling part 116 (e.g., a second coupling portion). As shown in FIG. 3, the first coupling knob 112 is selectively coupled to the first cleat engagement portion 34 of the main plate 12 while the first cleat 42 is adjustably coupled to the first bicycle shoe 40. On the other hand, as shown in FIG. 4, the coupling part 116 is selectively coupled to the second cleat engagement portion 36 of the second scale plate 16 while the second cleat 52 is adjustably coupled to the second bicycle shoe 50.

Figure 11:
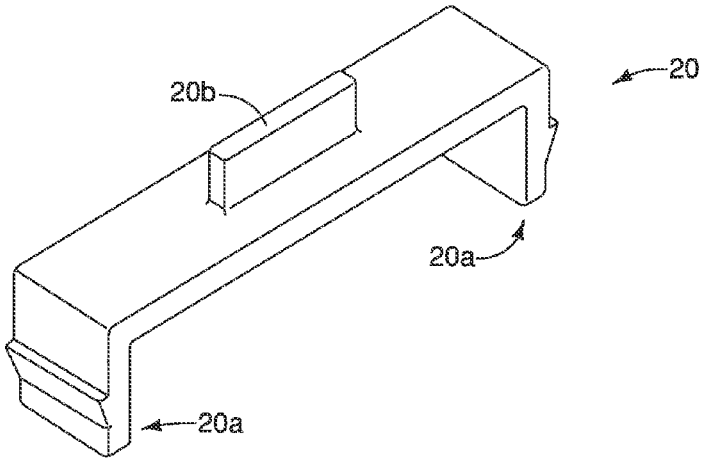
FIG. 11 is a bottom perspective view of a retainer of the bicycle cleat positioning kit illustrated in FIG. 1.

Referring now to FIG. 11, the detailed configuration of the retainer 20 will be described in detail. As shown in FIG. 11, the retainer 20 is basically a C-shaped member. The retainer 20 is integrally formed as a one-piece, unitary member. The retainer 20 is made of a plastic material, or any other suitable material. The retainer 20 has a pair of distal end portions 20*a* with latching pawls and a control protrusion 20*b*. As shown in FIGS. 3 and 4, the distal end portions 20*a* of the retainer 20 are disposed through the slits 80 of the main plate 12, respectively, and are latched with edges of the slits 80, respectively. Thus, the retainer 20 is slidably coupled to the main plate 12. In other words, the retainer 20 is movable with respect to the first and second sections 22 and 24.

Referring now to FIGS. 12 to 22, the procedures for attaching the bicycle cleat to a recommended position of the bicycle shoe by using the bicycle cleat positioning kit 10 and the procedures for measuring a cleat mounting position of the bicycle cleat with respect to the bicycle shoe will be described in detail.

Figure 12:
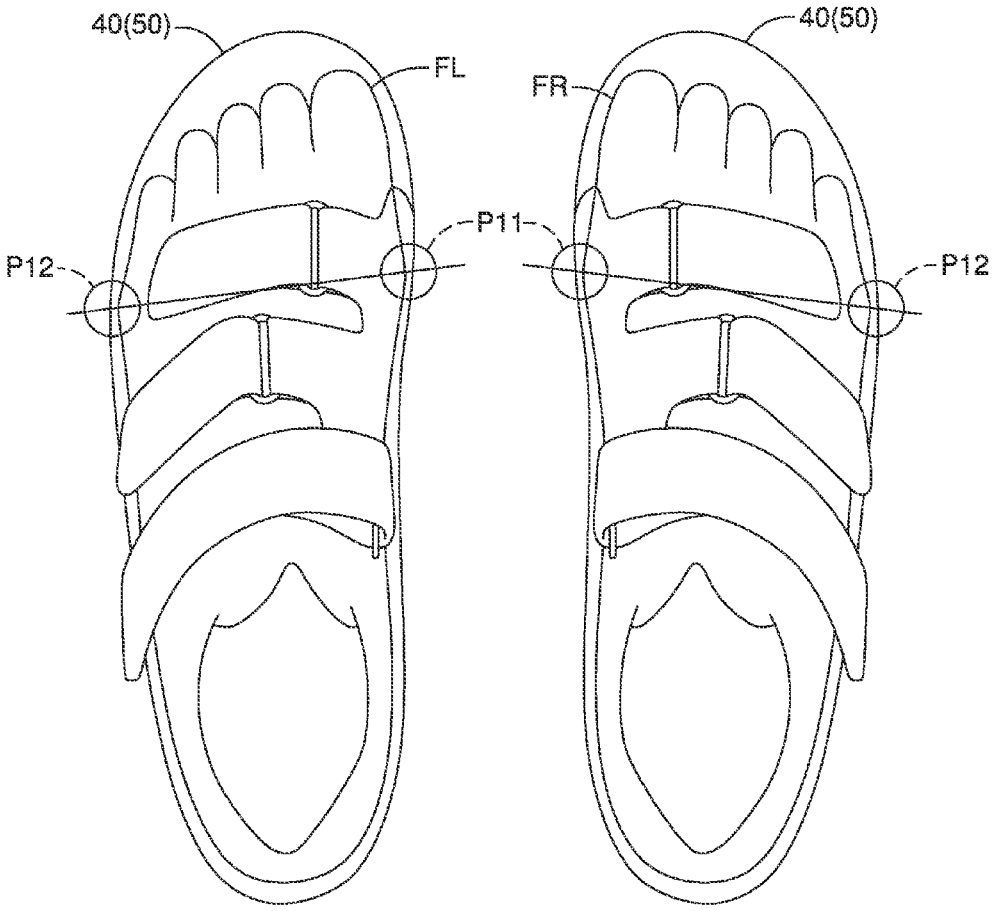
FIG. 12 is a schematic view of person's feet and bicycle shoes, illustrating thenar positions and hypothenar positions of the person's feet.

First, referring to FIGS. 12 to 14, the procedures for attaching the first cleat 42 to a recommended position of the first bicycle shoe 40 by using the bicycle cleat positioning kit 10 will be described in detail. As illustrated in FIG. 12, the procedures for attaching the first cleat 42 to a recommended position of the first bicycle shoe 40 by using the bicycle cleat positioning kit 10 include marking an outer surface of the upper of the first bicycle shoe 40 at a thenar position P11 and a hypothenar position P12 while a person (e.g., wearer of the first bicycle shoe 40) places his or her foot FL or FR in the first bicycle shoe 40. As shown in FIG. 12, the thenar position P11 corresponds to a ball of the thumb of each of the person's feet FL and FR while the hypothenar position P12 corresponds to a ball of the fifth finger of each of the person's feet FL and FR. If it is difficult to determine the thenar position P11 or the hypothenar position P12 from outside of the first bicycle shoe 40, markers or pointers can be attached to the person's feet FL and FR for easily determine the thenar position P11 or the hypothenar position P12 from outside of the first bicycle shoe 40.

Figure 13:
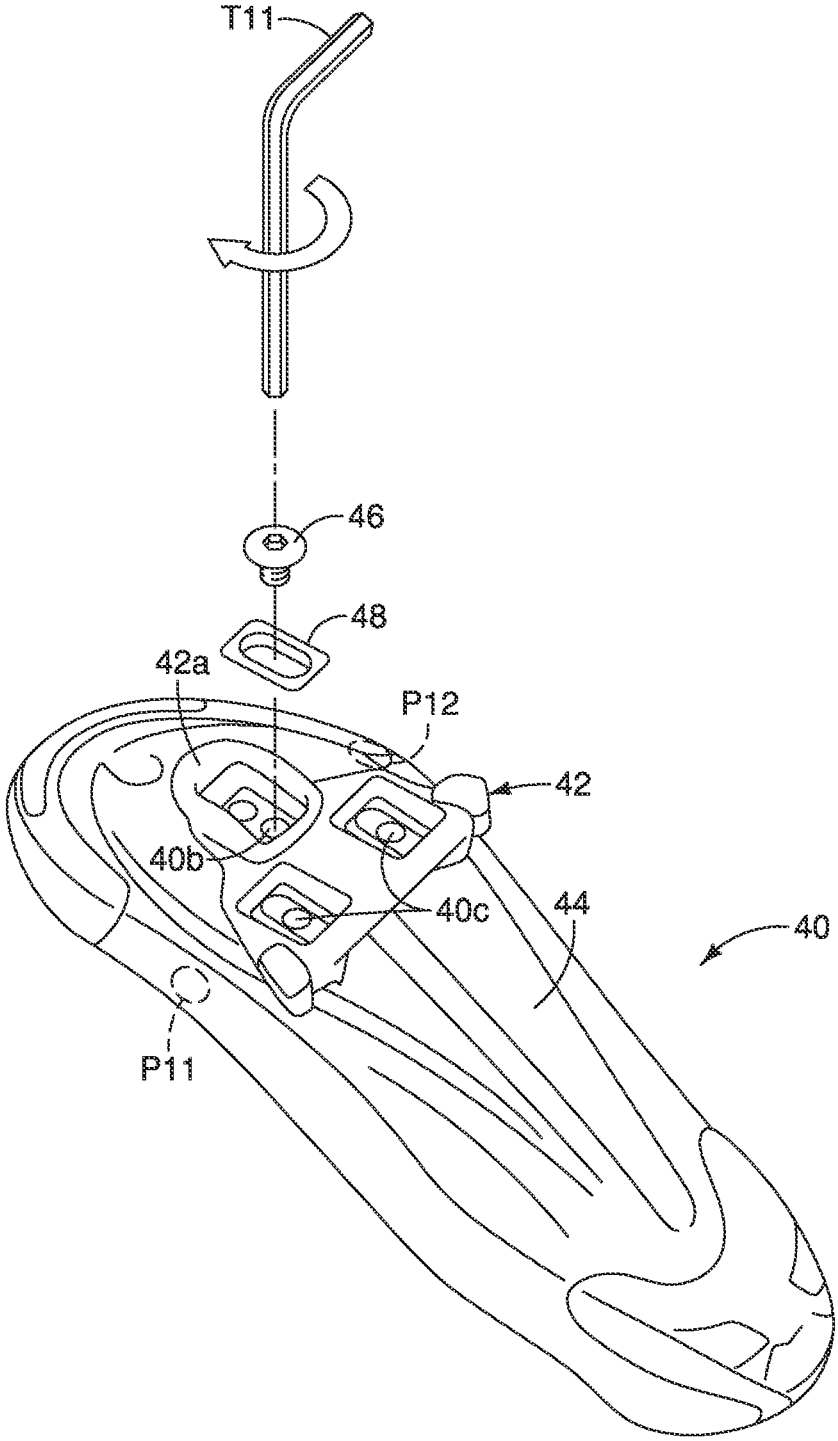
FIG. 13 is a perspective view of the road bike shoe illustrated in FIG. 3, a road bike cleat temporarily and adjustably coupled to the shoe sole of the road bike shoe for adjusting the road bike cleat to a recommended position.

As illustrated in FIG. 13, the first cleat 42 is temporarily and adjustably coupled to the first sole 44 of the first bicycle shoe 40 before the bicycle cleat positioning kit 10 is attached to the first bicycle shoe 40. When the first cleat 42 is temporarily coupled to the first sole 44 of the first bicycle shoe 40, the cleat mounting bolt 46 is not fully tightened to the screw hole 40*b* of the first sole 44. The cleat mounting bolt 46 is disposed through the elongated hole of the cleat washer 48 that is placed on the recessed seat of the first cleat 42, and threaded into the screw hole 40*b* of the first bicycle shoe 40 with a wrench T11 or any other suitable tool. If the positions of the screw holes 40*b* and 40*c* are adjustable, it is preferable to preset each of the positions of the screw holes 40*b* and 40*c* to a center position of an adjustable range of each of the screw holes 40*b* and 40*c*. However, alternatively, the positions of the screw holes 40*b* and 40*c* can be preset at different positions as needed and/or desired.

Figure 14:
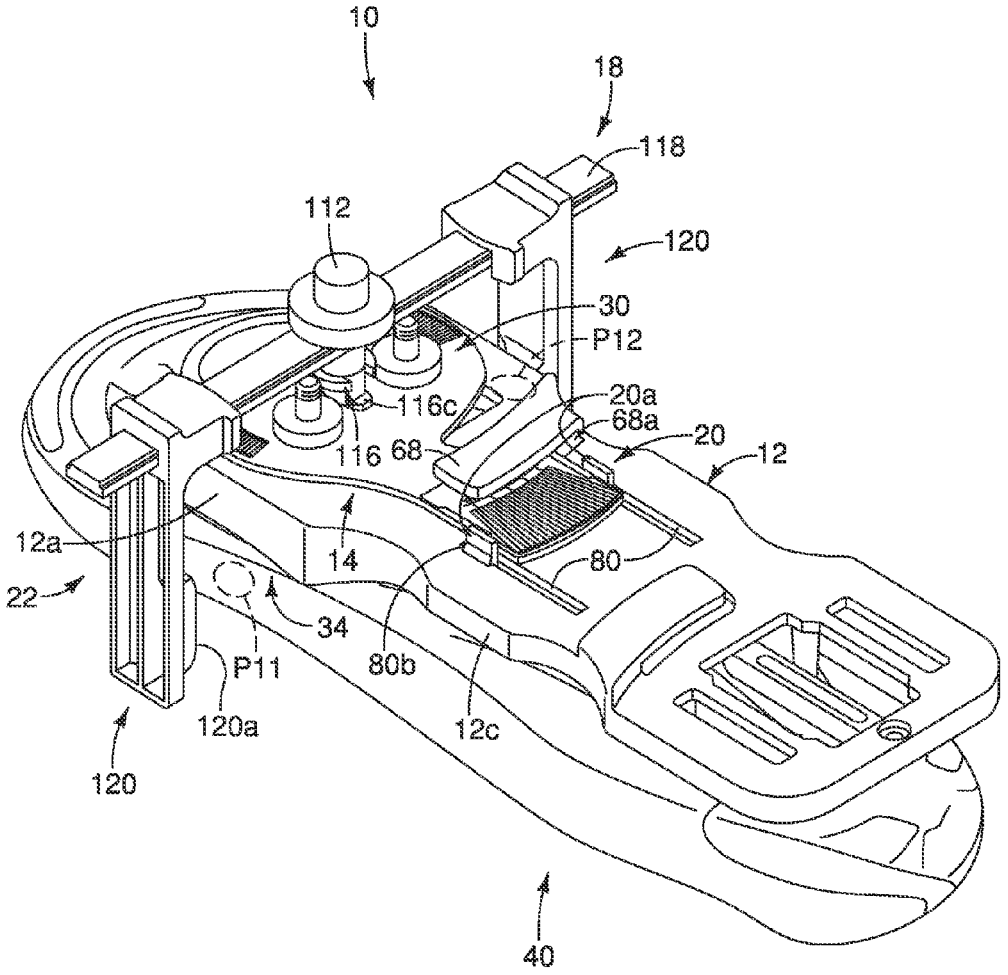
FIG. 14 is a perspective view of the adjustment assembly of the bicycle cleat positioning kit attached to the shoe sole of the road bike shoe.

As illustrated in FIG. 14, the bicycle cleat positioning kit 10 is attached to the first bicycle shoe 40 and the first cleat 42. Specifically, as shown in FIG. 3, the main plate 12 is first attached to the first cleat 42. In particular, the first cleat engagement portion 34 of the first end part 12*a* is engaged with the first cleat 42 such that the front flange part 42*a* of the first cleat 42 is engaged with the step portion 62 of the first cleat engagement portion 34 and the first cleat 42 is fittedly disposed within the aperture 60*a* of the first cleat engagement portion 34. In the illustrated embodiment, the retainer 20 is attached to the main plate 12 before the main plate 12 is attached to the first cleat 42. As shown in FIG. 3, the retainer 20 is positioned at first ends 80*a* of the slits 80 that are farther ends from the first end part 12*a* of the main plate 12. Then, the first scale plate 16 is overlaid on the first end part 12*a* and the middle part 12*c* of the main plate 12. Specifically, the first scale plate 14 is overlaid on the main plate 12 such that the shoe attachment bolt 96 (FIGS. 7 and 8) of the first shoe attachment portion 30 extend through the window portion 63 (FIG. 5) of the main plate 12, and then the first scale plate 14 slides into the gap 68*a* defined between the retaining tab 68 and the main plate 12. In other words, in the illustrated embodiment, at least a part of the first shoe attachment portion 30 of the first scale plate 14 is overlaid on the first cleat engagement portion 34 of the main plate 12 while the first shoe attachment portion 30 of the first scale plate 14 is attached to the first bicycle shoe 40 and the first cleat engagement portion 34 of the main plate 12 is attached to the first cleat 42. In the illustrated embodiment, as shown in FIG. 7, the first scale plate 14 has a notch portion 90*e* between the wide portion 90*a* and the narrow portion 90*b*. When the first scale plate 14 is overlaid on the main plate 12, the retaining tab 68 can pass through the notch portion 90*e* of the first scale plate 14, and then the first scale plate 14 can slide into the gap 68*a*. Thus, the first scale plate 14 can be easily installed to the main plate 12.

The first scale plate 14 is then fixedly coupled to the first sole 44 of the first bicycle shoe 40. Specifically, the screw parts 96*a* of the shoe attachment bolt 96 (FIGS. 7 and 8) of the first shoe attachment portion 30 are threaded into the screw holes 40*c* (FIG. 13) of the first sole 44 of the first bicycle shoe 40. With this arrangement, the main plate 12 is movable with the first cleat 42 with respect to the first scale plate 14 and the first bicycle shoe 40. Thus, the first cleat engagement portion 34 of the main plate 12 is movably arranged with respect to the first shoe attachment portion 30 of the first scale plate 16. The first cleat engagement portion 34 of the main plate 12 is movable with the first cleat 42 with respect to the first bicycle shoe 40 while the first cleat 42 is adjustably coupled to the first bicycle shoe 40. Furthermore, the first scale plate 14 is fixedly couple to the first bicycle shoe 40. Thus, the first cleat engagement portion 34 of the main plate 12 is movable with the first cleat 42 with respect to the first bicycle shoe 40 while the first shoe attachment portion 30 of the first scale plate 14 is stationary with respect to the first bicycle shoe 40. In the illustrated embodiment, as shown in FIG. 8, the male screw parts 97*a* of the annular bolts 97 have an outer diameter that is equal to or slightly smaller than that of the attachment openings 90*c* of the plate body 90. In particular, if the male screw parts 97*a* of the annular bolts 97 have an outer diameter that is smaller than that of the attachment openings 90*c* of the plate body 90, then the attachment locations of the annular bolts 97 and the nuts 98 can be adjusted relative to attachment openings 90*c* of the plate body 90. As a result, the width between the shoe attachment bolts 96 can be adjusted. Thus, if it is difficult to thread the shoe attachment bolts 96 into the screw holes 40*c* of the first bicycle shoe 40, then the width between the shoe attachment bolts 96 should be adjusted by loosing the annular bolts 97 from the nuts 98 and adjusting the positions of the annular bolts 97 and the nuts 98 relative to the plate body 90. Furthermore, when the shoe attachment bolts 96 are threaded into the screw holes 40*c*, the shoe attachment bolts 96 should be alternately tightened little by little before fully tightening one of the shoe attachment bolts 96.

Furthermore, as shown in FIG. 14, the cleat adjustment member 18 is fixedly coupled to the main plate 12. Specifically, the cleat adjustment member 18 is attached to the main plate 12 such that the oval-shaped end portion of the coupling part 116 of the cleat adjustment member 18 is disposed on the coupling portion 64 (FIG. 3) of the main plate 12 after passing through a notch portion 90*d* (FIGS. 7 and 8) of the plate body 90 of the first scale plate 14. Furthermore, the screw section 112*c* of the first knob 112 is threaded into the screw hole 66 of the coupling portion 64 of the main plate 12 by rotating the first knob 112. With this arrangement, the cleat adjustment member 18 is fixedly coupled to the main plate 12. In other words, the cleat adjustment member 18 is movably arranged with respect to the first shoe attachment portion 30 of the first scale plate 14 while the cleat adjustment member 18 is coupled to the first cleat engagement portion 34 of the main plate 12. Furthermore, the cleat adjustment member 18 is movable with the first cleat 42 with respect to the first bicycle shoe 40 while the first cleat 42 is adjustably coupled to the first bicycle shoe 40.

Then, as shown in FIG. 14, the retainer 20 is slid along the slits 80 towards the first end part 12*a* of the main plate such that the retainer 20 is positioned at second ends 80*b* of the slits 80 that are closer ends to the first end part 12*a* of the main plate 12. When the retainer 20 is positioned at the second ends 80*b* of the slits 80, the distal end portions 20*a* are engaged with side edges of the narrow portion 90*b* of the plate body 90 of the first scale plate 14, thereby retaining the first scale plate 14 with respect to the main plate 12. In other words, the retainer 20 is arranged to relatively retain the first shoe attachment portion 30 of the first scale plate 14 with respect to the first cleat engagement portion 34 of the main plate 12 while the first cleat 42 is adjustably coupled to the first bicycle shoe 40.

Furthermore, as shown in FIG. 14, the main plate 12 and the cleat adjustment member 18 are adjusted such that the pointers 120*a* of the pointing parts 120 of the cleat adjustment member 18 contacts with the thenar position P11 and the hypothenar position P12 on the first bicycle shoe 40. In other words, in the illustrated embodiment, the cleat adjustment member 18 is adjustable relative to the thenar position P11 and the hypothenar position P12 (e.g., first reference positions or recommended positions) on the first bicycle shoe 40 while the first cleat 42 is adjustably coupled to the first bicycle shoe 40. During this adjustment, the main plate 12 is adjusted in the lengthwise direction, the support bar 118 of the cleat adjustment member 18 is rotated with the main plate 12 in the rotational direction, and the pointing parts 120 of the cleat adjustment member 18 are slid along the support bar 118. After this adjustment, the cleat mounting bolt 46 is fully tightened to the screw hole 40*b* of the first sole 44 with a predetermined torque before detaching the main plate 12, the first scale plate 14 and the cleat adjustment member 18 from the first bicycle shoe 40. During this detachment, the screw section 112*c* of the first knob 112 is loosened from the screw hole 66 of the coupling portion 64 of the main plate 12, the shoe attachment bolts 96 of the first scale plate 14 are loosened from the screw holes 40*c* of the first bicycle shoe 40, and then the main plate 12 is detached from the first cleat 42. Then, a pair of cleat mounting bolts is fastened to the screw holes 40*c* of the first bicycle shoe 40 to fixedly couple the first cleat 42 to the first sole 44 of the first bicycle shoe 40. Specifically, the cleat mounting bolts are disposed through elongated holes of cleat washers that are placed on recessed seats of the first cleat 42, and then threaded into the screw holes 40*c* of the first bicycle shoe 40 with the predetermined torque with the wrench T11 or any other suitable tool.

Figure 15:
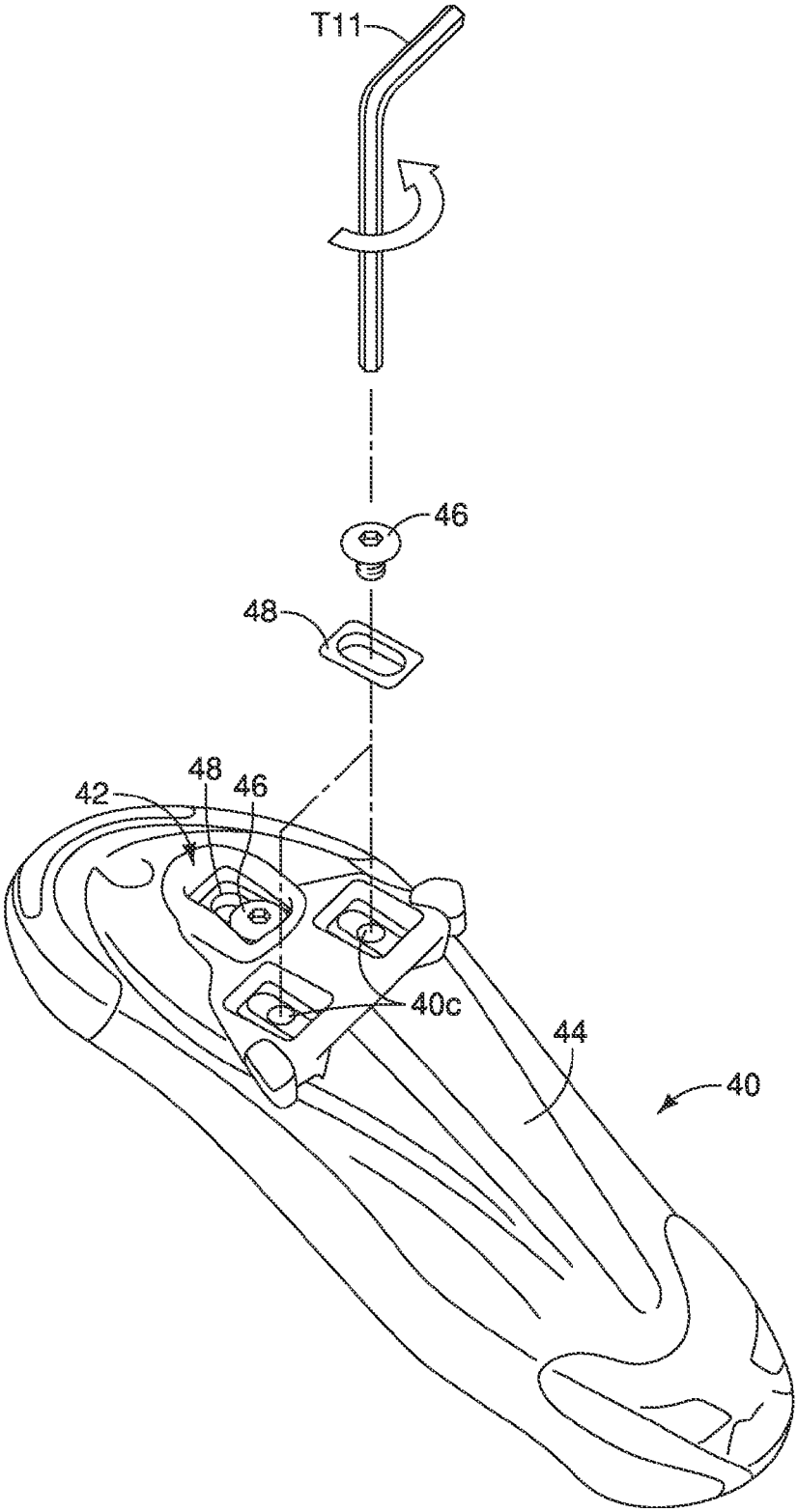
FIG. 15 is a perspective view of the road bike shoe illustrated in FIG. 3, illustrating a pair of cleat mounting bolts loosened for measuring a cleat mounting position of the road bike cleat relative to the road bike shoe.
Figure 16:
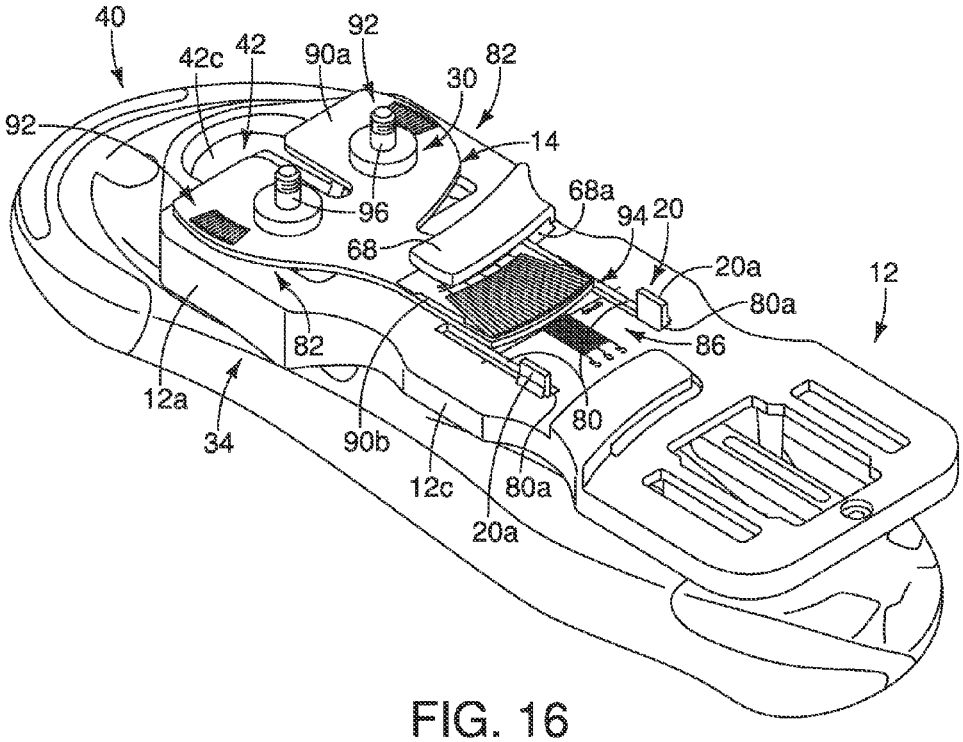
FIG. 16 is a perspective view of a measurement assembly of the bicycle cleat positioning kit attached to the shoe sole of the road bike shoe for measuring the cleat mounting position of the road bike cleat relative to the road bike shoe.

Next, referring to FIGS. 15 to 17, the procedures for measuring a cleat mounting position of the first cleat 42 with respect to the first bicycle shoe 40 will be described in detail. As shown in FIG. 15, for attaching the bicycle cleat positioning kit 10 to the first bicycle shoe 40, the heel-side cleat mounting bolts 46 and the cleat washers 48 are removed from the first cleat 42 with the wrench T11. On the other hand, the toe-side cleat mounting bolt 46 is fully tightened to non-movably couple the first cleat 42 to the first sole 44 of the first bicycle shoe 40. Then, as shown in FIG. 16, the main plate 12 and the first scale plate 14 are attached to the first cleat 42 and the first bicycle shoe 40, respectively. Specifically, as shown in FIG. 16, the main plate 12 is attached to the first cleat 42 in the same manner described above. Specifically, the first cleat engagement portion 34 of the first end part 12*a* is engaged with the first cleat 42 such that the front flange part 42*a* of the first cleat 42 is engaged with the step portion 62 (FIGS. 5 and 6) of the first cleat engagement portion 34 and the first cleat 42 is fittedly disposed within the aperture 60*a* (FIGS. 5 and 6) of the first cleat engagement portion 34. As shown in FIG. 16, the retainer 20 is positioned at the first ends 80*a* of the slits 80 of the main plate 12. Then, the first scale plate 16 is overlaid on the first end part 12*a* and the middle part 12*c* of the main plate 12 in the same manner described above. Specifically, the first scale plate 14 is overlaid on the main plate 12 such that the shoe attachment bolt 96 of the first shoe attachment portion 30 extend through the window portion 63 (FIGS. 5 and 6) of the main plate 12, and then the first scale plate 14 slides into the gap 68*a* defined between the retaining tab 68 and the main plate 12. The first scale plate 14 is then fixedly coupled to the first sole 44 of the first bicycle shoe 40. Specifically, the screw parts 96*a* (FIG. 8) of the shoe attachment bolt 96 of the first shoe attachment portion 30 are threaded into the screw holes 40*c* (FIG. 15) of the first sole 44 of the first bicycle shoe 40. As shown in FIG. 16, the retainer 20 is positioned at the first ends 80*a* of the slits 80 of the main plate 12 for measuring the cleat mounting position of the first cleat 42 with respect to the first bicycle shoe 40.

Then, the cleat mounting position of the first cleat 42 with respect to the first bicycle shoe 40 is measured by using the first straight scales 82 and the third straight scale 86 of the main plate 12, and the first angle scales 92 and the second angle scale 94 of the first scale plate 14.

More specifically, a lengthwise position of the first cleat 42 is measured by using the first straight scales 82 of the main plate 12 and the first angle scales 92 of the first scale plate 14. Specifically, as shown in FIG. 17, a parallel pair of a line segment of one of the first straight scales 82 and a line segment of corresponding one of the first angle scales 92 is found. Then, the value corresponding to the found line segment of the one of the first straight scales 82 in the one of the first straight scales 82 is measured as the lengthwise position of the first cleat 42 with respect to the first bicycle shoe 40. In the illustrated embodiment, since the plate body 90 of the first scale plate 14 is transparent, the value of the first straight scale 82 of the main plate 12 can be read through the first scale plate 14.

Figure 17:
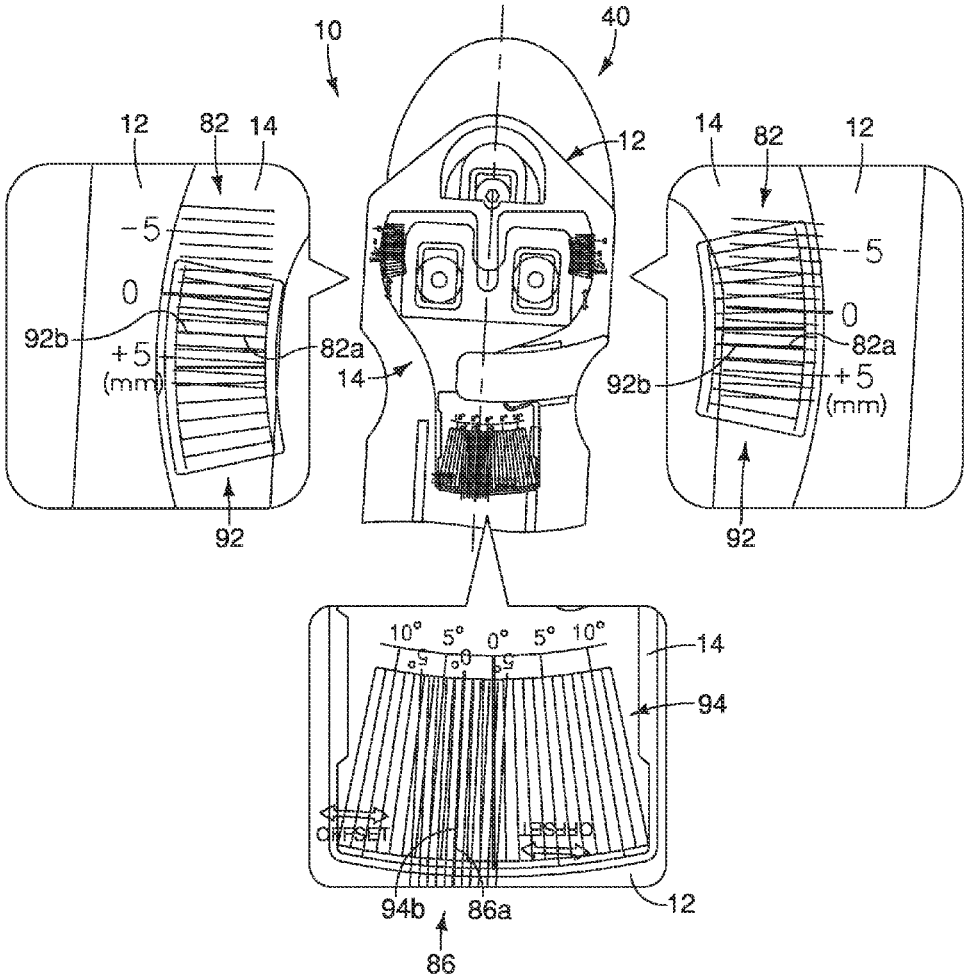
FIG. 17 is a partial top plan view of the measurement assembly of the bicycle cleat positioning kit, illustrating an example of measurement of the cleat mounting position of the road bike cleat relative to the road bike shoe.

For example, as shown in FIG. 17, a line segment 82*a* of the first straight scale 82 on the right side is parallel to a line segment 92*b* of the first angle scale 92 on the right side. The value corresponding to the line segment 82*a* of the first straight scale 82 is "+3" as shown in FIG. 17. In the illustrated embodiment, when the first cleat 42 is adjusted relative to a reference position of the first bicycle shoe 40 towards a toe-side of the first bicycle shoe 40, then the lengthwise position of the first cleat 42 becomes positive value. On the other hand, when the first cleat 42 is adjusted relative to the reference position of the first bicycle shoe 40 toward a heel-side of the first bicycle shoe 40, then the lengthwise position of the first cleat 42 becomes negative value. Thus, in this illustrated example, the first cleat 42 is adjusted relative to the reference position of the first bicycle shoe 40 towards the toe-side by 3 mm. Of course, this relationship between the adjustment directions of the first cleat 42 relative to the reference position of the first bicycle shoe 40 and the signs of the value can be oppositely defined. Furthermore, in the illustrated example, a line segment 82*a* of the first straight scale 82 on the left side is also parallel to a line segment 92*b* of the first angle scale 92 on the left side. The value corresponding to the line segment 82*a* of the first straight scale 82 is "+3" as shown in FIG. 17. However, the lengthwise position of the first cleat 42 can be measured if one parallel pair of a line segment of one of the first straight scales 82 and a line segment of corresponding one of the first angle scales 92 is found.

Furthermore, a widthwise position of the first cleat 42 and an angle of the first cleat 42 are measured by using the third straight scale 86 of the main plate 12 and the second angle scale 94 of the first scale plate 14. Specifically, as shown in FIG. 17, a parallel pair of a line segment of the third straight scale 86 and a line segment of the second angle scale 94 is found. Then, the value corresponding to the found line segment of the third straight scale 86 in the third straight scale 86 is measured as the widthwise position of the first cleat 42 with respect to the first bicycle shoe 40. In the illustrated embodiment, since the plate body 90 of the first scale plate 14 is transparent, the value of the third straight scale 86 of the main plate 12 can be read through the first scale plate 14. Furthermore, the value corresponding to the found line segment of the second angle scale 94 in the second angle scale 94 is measured as the angle of the first cleat 42 with respect to the first bicycle shoe 40.

For example, as shown in FIG. 17, a line segment 86*a* of the third straight scale 86 is parallel to a line segment 94*b* of the second angle scale 94. The value corresponding to the line segment 86*a* of the third straight scale 86 is "0" as shown in FIG. 17, which indicates that the first cleat 42 is aligned to the reference position in the widthwise direction. When recording the widthwise position of the first cleat 42, the value corresponding to the line segment 86*a* of the third straight scale 86 is recorded with signs, such as "IN" and "OUT" to clarify the adjustment directions of the first cleat 42 relative to the reference position of the first bicycle shoe 40. For example, when the first cleat 42 is adjusted relative to the reference position of the first bicycle shoe 40 towards inboard side of the first bicycle shoe 40, then the value corresponding to the line segment 86*a* of the third straight scale 86 is recorded with sign "IN." On the other hand, when the first cleat 42 is adjusted relative to the reference position of the first bicycle shoe 40 towards outboard side of the first bicycle shoe 40, then the value corresponding to the line segment 86*a* of the third straight scale 86 is recorded with sign "OUT." Of course, this relationship between the adjustment directions of the first cleat 42 relative to the reference position of the first bicycle shoe 40 and the signs of the value can be oppositely defined.

Furthermore, the value corresponding to the line segment 94*b* of the second angle scale 94 is "3" as shown in FIG. 17, which indicates that the first cleat 42 is rotated in the clockwise direction in FIG. 17 by 3 degrees relative to a reference orientation of the first bicycle shoe 40. When recording the angle of the first cleat 42, the value corresponding to the line segment 94*b* of the second angle scale 94 is recorded with signs, such as "IN" and "OUT" to clarify the adjustment directions of the first cleat 42 relative to the reference orientation of the first bicycle shoe 40. For example, when the first cleat 42 is adjusted relative to the reference orientation of the first bicycle shoe 40 such that the toe of the first bicycle shoe 40 is arranged farther from a center line of a bicycle frame than the heel of the first bicycle shoe 40 (i.e., "toe-out" or "open stance") while the first bicycle shoe 40 is attached to a bicycle pedal with the first cleat 42, then the value corresponding to the line segment 94*a* of the second angle scale 94 is recorded with sign "IN." On the other hand, when the first cleat 42 is adjusted relative to the reference orientation of the first bicycle shoe 40 such that the toe of the first bicycle shoe 40 is arranged closer to the center line of the bicycle frame than the heel of the first bicycle shoe 40 (i.e., "toe-in" or "closed stance") while the first bicycle shoe 40 is attached to the bicycle pedal with the first cleat 42, then the value corresponding to the line segment 94*a* of the second angle scale 94 is recorded with sign "OUT." Of course, this relationship between the adjustment directions of the first cleat 42 relative to the reference orientation of the first bicycle shoe 40 and the signs of the value can be oppositely defined.

It should be understood from the drawings and the description herein that the term inboard side refers to the right side of a shoe for the left foot, and the left side of a shoe for the right foot. In other words the inboard side is the side of the shoe facing the shoe on the other foot of the wearer. Similarly, the term outboard side refers to the left side of the shoe for the left foot and the right side of the shoe for the right foot. The outboard side is the side of the shoe facing away from the shoe on the other foot.

In the illustrated embodiment, the first angle scales 92 and the second angle scale 94 form the first shoe reference indicator of the present invention. Thus, in the illustrated embodiment, the first shoe attachment portion 30 of the first scale plate 14 has the first shoe reference indicator with respect to the first bicycle shoe 40. Furthermore, in the illustrated embodiment, the first straight scales 82 and the third straight scale 86 form the first cleat adjusting indicator of the present invention. Thus, in the illustrated embodiment, the first cleat engagement portion 34 of the main plate 12 has the first cleat adjusting indicator. The first cleat adjusting indicator is indicative of adjustment amounts of the first cleat 42 with respect to the first shoe reference indicator.

In the illustrated embodiment, the measured cleat mounting position (i.e., the lengthwise position, the widthwise position, and the angle) are used for attaching a bicycle cleat to a bicycle shoe at the same position as the measured cleat mounting position while newly installing the bicycle cleat to the bicycle shoe or while replacing an old bicycle cleat. On the other hand, the bicycle cleat positioning kit 10 assembled as shown in FIG. 16 can also be used for fine-tuning the cleat mounting position of the first cleat 42 relative to the first bicycle shoe 40. Specifically, the bicycle cleat positioning kit 10 is assembled in an identical manner as shown in FIG. 16, except that the cleat mounting bolt 46 is not fully tightened to the screw hole 40*b* of the first sole 44 such that the first cleat 42 is adjustable relative to the first bicycle shoe 40. Then, the main plate 12 is adjusted relative to the first scale plate 14 until a desired lengthwise position, a desired widthwise position, and a desired angle can be obtained.

Next, referring to FIGS. 12, 18 and 19, the procedures for attaching the second cleat 52 to a recommended position of the second bicycle shoe 50 by using the bicycle cleat positioning kit 10 will be described in detail. As illustrated in FIG. 12, the procedures for attaching the second cleat 52 to a recommended position of the second bicycle shoe 50 by using the bicycle cleat positioning kit 10 include marking an outer surface of the upper of the second bicycle shoe 50 at a thenar position P11 and a hypothenar position P12 while a person (e.g., wearer of the second bicycle shoe 50) places his or her foot FL or FR in the second bicycle shoe 50. As shown in FIG. 12, the thenar position P11 corresponds to a ball of the thumb of each of the person's feet FL and FR while the hypothenar position P12 corresponds to a ball of the fifth finger of each of the person's feet FL and FR. If it is difficult to determine the thenar position P11 or the hypothenar position P12 from outside of the second bicycle shoe 50, markers or pointers can be attached to the person's feet FL and FR for easily determine the thenar position P11 or the hypothenar position P12 from outside of the second bicycle shoe 50.

Figure 18:
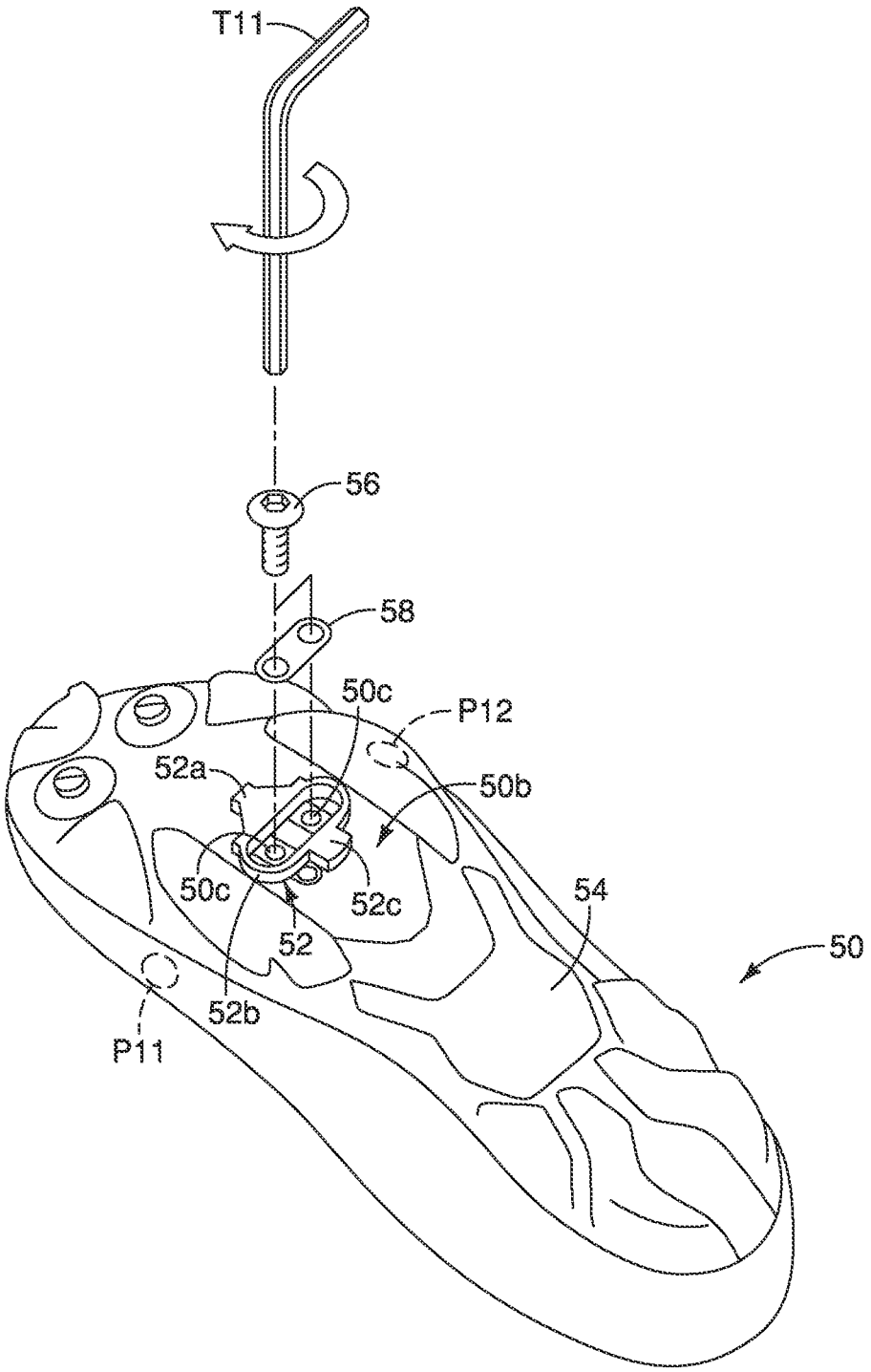
FIG. 18 is a perspective view of the mountain bike shoe illustrated in FIG. 4, a mountain bike cleat temporarily and adjustably coupled to the shoe sole of the mountain bike shoe for adjusting the mountain bike cleat to a recommended position.

As illustrated in FIG. 18, the second cleat 52 is temporarily and adjustably coupled to the second sole 54 of the second bicycle shoe 50 before the bicycle cleat positioning kit 10 is attached to the second bicycle shoe 50. When the second cleat 52 is temporarily coupled to the second sole 54 of the second bicycle shoe 50, the cleat mounting bolts 56 are not fully tightened to the screw holes 50*c* of the second sole 54. The cleat mounting bolts 56 are disposed through the through holes of the cleat washer 58 that is placed on the recessed seat of the second cleat 52, and threaded into the screw holes 50*c* of the second bicycle shoe 50 with a wrench T11 or any other suitable tool. If the positions of the screw holes 50*c* are adjustable, it is preferable to preset each of the positions of the screw holes 50*c* to a center position of an adjustable range of each of the screw holes 50*c*. However, alternatively, the positions of the screw holes 50*c* can be preset at different positions as needed and/or desired. In the illustrated embodiment, the second bicycle shoe 50 can be either a first type of mountain bike shoe which includes a pair of long oval openings on the second sole 54 that define a large adjustable range of the lengthwise position of the screw holes 50*c* of the second sole 54 or a second type of mountain bike shoe which includes a pair of short oval openings on the second sole 54 that define a small adjustable range of the lengthwise position of the screw holes 50*c* of the second sole 54. The short oval openings of the second type of the mountain bike shoe are shorter than the long oval openings of the first type of the mountain bike shoe.

Figure 19:
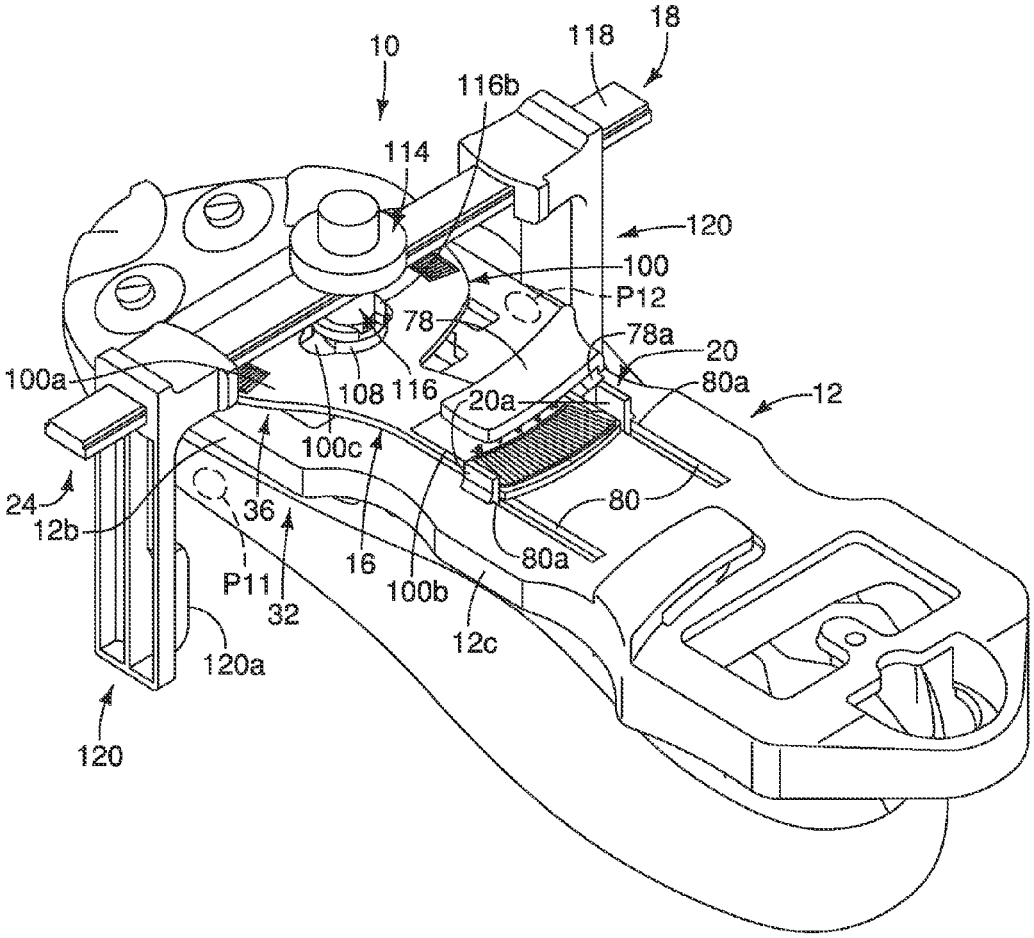
FIG. 19 is a perspective view of the adjustment assembly of the bicycle cleat positioning kit attached to the shoe sole of the mountain bike shoe.

As illustrated in FIG. 19, the bicycle cleat positioning kit 10 is attached to the second bicycle shoe 50 and the second cleat 52. Specifically, as shown in FIG. 4, the main plate 12 is first attached to the second bicycle shoe 50. In particular, the second shoe attachment portion 32 of the second end part 12*b* is engaged with the second bicycle shoe 50 such that the protruding parts 70 (FIG. 6) of the second shoe attachment portion 32 of the second bicycle shoe 50 fittedly mate with the side walls of the recess 50*b* (FIG. 18) of the second sole 54 of the second bicycle shoe 50. In the illustrated embodiment, the main plate 12 is attached to a predetermined position of the second bicycle shoe 50 in the lengthwise direction of the second bicycle shoe 50 according to the type of the second bicycle shoe 50. Specifically, as shown in FIG. 5, the support beam 74 of the second end part 12*b* of the main plate 12 has first and second indicators 74*a* and 74*b* on a top surface of the support beam 74. In the illustrated embodiment, the first and second indicators 74*a* and 74*b* are arranged next to each other in the lengthwise direction of the main plate 12. In the illustrated embodiment, the first and second indicators 74*a* and 74*b* are grooves formed in the top surface of the support beam 74. When the second bicycle shoe 50 is the first type of the mountain bike shoe with the long oval openings, then the main plate 12 is attached to the second bicycle shoe 50 such that the first indicators 74*a* of the main plate 12 align to toe-side ends of the long oval openings of the second bicycle shoe 50 in the lengthwise direction as viewed in the widthwise direction. On the other hand, when the second bicycle shoe 50 is the second type of the mountain bike shoe with the short oval openings, then the main plate 12 is attached to the second bicycle shoe 50 such that the second indicator 74*b* of the main plate 12 align to toe-side ends of the short oval openings of the second bicycle shoe 50 in the lengthwise direction as viewed in the widthwise direction. In the illustrated embodiment, the retainer 20 is attached to the main plate 12 before the main plate 12 is attached to the second bicycle shoe 50. As shown in FIG. 4, the retainer 20 is preferably positioned at the second ends 80*b* of the slits 80 when the main plate 12 is attached to the second bicycle shoe 50. Then, the second scale plate 16 is overlaid on the second end part 12*b* and the middle part 12*c* of the main plate 12. Specifically, the second scale plate 16 is overlaid on the main plate 12 such that the front and rear clamping parts 106*a* and 106*b* (FIG. 10) of the second cleat engagement portion 36 of the second scale plate 16 extend through the window portion 72 (FIGS. 5 and 6) of the main plate 12, and the front and rear clamping parts 106*a* and 106*b* are engaged with the outer periphery of the second cleat 52. Then, the second scale plate 16 slides into the gap 78*a* defined between the retaining tab 78 and the main plate 12. In other words, in the illustrated embodiment, at least a part of the second cleat engagement portion 36 of the second scale plate 16 is overlaid on the second shoe attachment portion 32 of the main plate 12 while the second shoe attachment portion 32 of the main plate 12 is attached to the second bicycle shoe 50 and the second cleat engagement portion 36 of the second scale plate 16 is attached to the second cleat 52. In the illustrated embodiment, as shown in FIG. 9, the second scale plate 16 has a notch portion 100*e* between the wide portion 100*a* and the narrow portion 100*b*. When the second scale plate 16 is overlaid on the main plate 12, the retaining tab 78 can pass through the notch portion 100*e* of the second scale plate 16, and then the second scale plate 16 can slide into the gap 78*a*. Thus, the second scale plate 16 can be easily installed to the main plate 12.

With this arrangement, the main plate 12 fittedly mates with the second bicycle shoe 50 while the second scale plate 16 fittedly mates with the second cleat 52. In other words, the main plate 12 is movable with the second bicycle shoe 50 with respect to the second scale plate 16 and the second cleat 52. Thus, the second cleat engagement portion 36 of the second scale plate 16 is movably arranged with respect to the second shoe attachment portion 32 of the main plate 12. The second cleat engagement portion 36 of the second scale plate 16 is movable with the second cleat 52 with respect to the second bicycle shoe 50 while the second cleat 52 is adjustably coupled to the second bicycle shoe 50. Furthermore, the main plate 12 is fixedly couple to the second bicycle shoe 50. Thus, the second cleat engagement portion 36 of the second scale plate 16 is movable with the second cleat 52 with respect to the second bicycle shoe 50 while the second shoe attachment portion 32 of the main plate 12 is stationary with respect to the second bicycle shoe 50.

Furthermore, as shown in FIG. 19, the cleat adjustment member 18 is fixedly coupled to the second scale plate 16. Specifically, the cleat adjustment member 18 is attached to the second scale plate 16. In particular, the oval-shaped end portion of the coupling part 116 (FIG. 10) of the cleat adjustment member 18 is inserted into the central opening 100*c* of the plate body 100 of the second scale plate 16, and then the second coupling knob 114 is rotated in the clockwise direction of FIG. 19 such that the first and second coupling flanges 116*b* and 116*c* of the coupling part 116 axially and securely sandwich the coupling lips 108 of the plate body 100 of the second scale plate 16. With this arrangement, the cleat adjustment member 18 is securely coupled to the second scale plate 16. In other words, the cleat adjustment member 18 is movably arranged with respect to the second shoe attachment portion 32 of the main plate 12 while the cleat adjustment member 18 is coupled to the second cleat engagement portion 36 of the second scale plate 16. Furthermore, the cleat adjustment member 18 is movable with the second cleat 52 with respect to the second bicycle shoe 50 while the second cleat 52 is adjustably coupled to the second bicycle shoe 50.

Then, as shown in FIG. 19, the retainer 20 is slid along the slits 80 towards the second end part 12*b* of the main plate such that the retainer 20 is positioned at the first ends 80*a* of the slits 80. When the retainer 20 is positioned at the first ends 80*a* of the slits 80, the distal end portions 20*a* are engaged with side edges of the narrow portion 100*b* of the plate body 100 of the second scale plate 16, thereby retaining the second scale plate 16 with respect to the main plate 12. In other words, the retainer 20 is arranged to relatively retain the second shoe attachment portion 32 of the main plate 12 with respect to the second cleat engagement portion 36 of the second scale plate 16 while the second cleat 52 is adjustably coupled to the second bicycle shoe 50.

Furthermore, as shown in FIG. 19, the main plate 12 and the cleat adjustment member 18 are adjusted such that the pointers 120*a* of the pointing parts 120 of the cleat adjustment member 18 contacts with the thenar position P11 and the hypothenar position P12 on the second bicycle shoe 50. In other words, in the illustrated embodiment, the cleat adjustment member 18 is adjustable relative to the thenar position P11 and the hypothenar position P12 (e.g., second reference positions or recommended positions) on the second bicycle shoe 50 while the second cleat 52 is adjustably coupled to the second bicycle shoe 50. During this adjustment, the second scale plate 16 is adjusted in the lengthwise direction with respect to the main plate 12, the support bar 118 of the cleat adjustment member 18 is rotated with the second coupling knob 114 and the coupling part 116 in the rotational direction, and the pointing parts 120 of the cleat adjustment member 18 are slid along the support bar 118. After this adjustment, the cleat adjustment member 18 is removed from the second scale plate 16. Specifically, the second coupling knob 114 is rotated in the counter-clockwise direction in FIG. 19 to disengage the coupling part 116 from the second scale plate 16 while maintaining the position of the second scale plate 16 with respect to the main plate 12. Then, the wrench T11 (FIG. 18) is inserted into the central opening 100*c* of the plate body 100 of the second scale plate to fully tighten the cleat mounting bolts 56 to the screw holes 50*c* of the second sole 54 with a predetermined torque. Then, the main plate 12 and the second scale plate 16 are detached from the first bicycle shoe 40.

Figure 20:
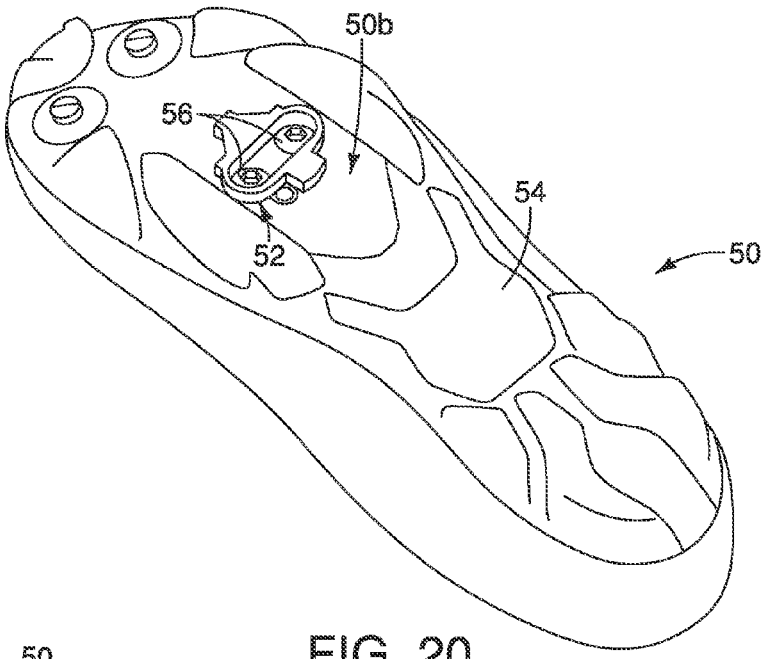
FIG. 20 is a perspective view of the mountain bike shoe illustrated in FIG. 4, illustrating the mountain bike cleat coupled to the shoe sole of the mountain bike shoe for measuring a cleat mounting position of the mountain bike cleat relative to the mountain bike shoe.
Figure 21:
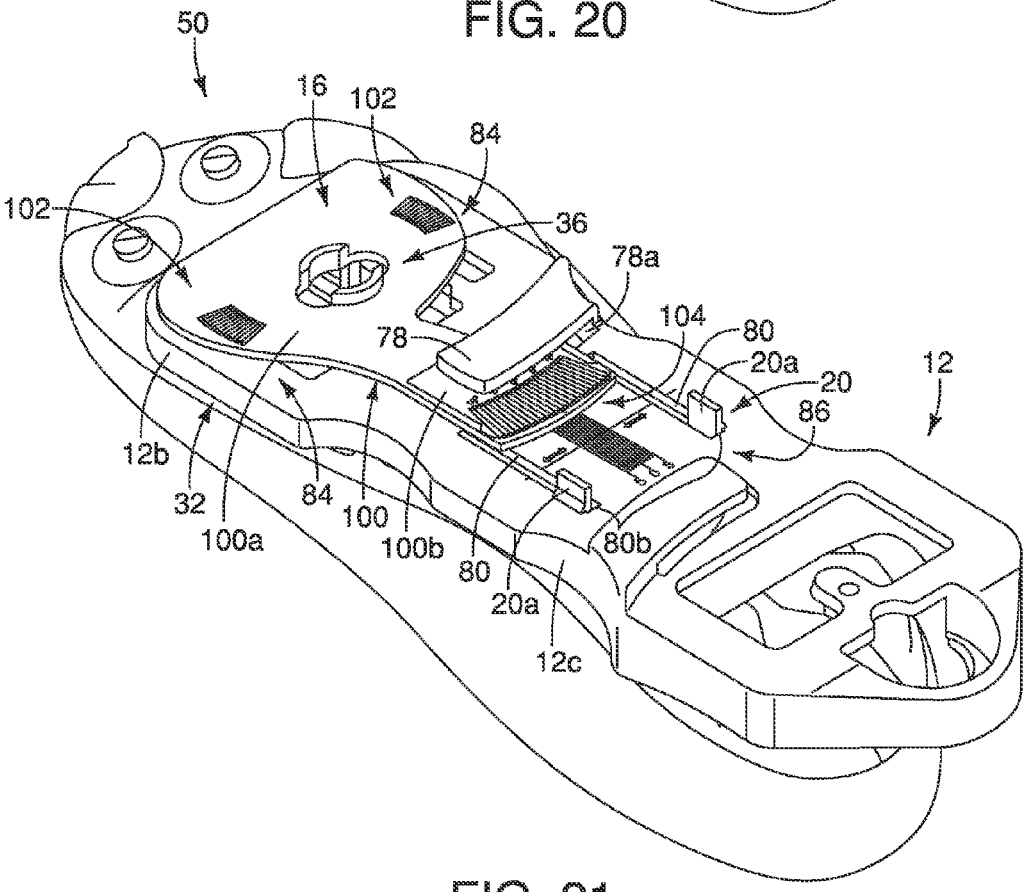
FIG. 21 is a perspective view of a measurement assembly of the bicycle cleat positioning kit attached to the shoe sole of the mountain bike shoe for measuring the cleat mounting position of the mountain bike cleat relative to the mountain bike shoe.

Next, referring to FIGS. 20 to 22, the procedures for measuring a cleat mounting position of the second cleat 52 with respect to the second bicycle shoe 50 will be described in detail. As shown in FIG. 20, the cleat mounting bolts 56 are fully tightened to non-movably couple the second cleat 52 to the second sole 54 of the second bicycle shoe 50. Then, as shown in FIG. 21, the main plate 12 and the second scale plate 16 are attached to the second bicycle shoe 50 and the second scale plate 16, respectively. Specifically, as shown in FIG. 21, the main plate 12 is attached to the second bicycle shoe 50 in the same manner described above. Specifically, the second shoe attachment portion 32 of the second end part 12*b* is engaged with the recess 50*b* (FIG. 20) of the second bicycle shoe 50. The main plate 12 is attached to the predetermined position of the second bicycle shoe 50 in the lengthwise direction of the second bicycle shoe 50 according to the type of the second bicycle shoe 50 (i.e., the first type or the second type). As shown in FIG. 21, the retainer 20 is positioned at the second ends 80*b* of the slits 80 of the main plate 12. Then, the second scale plate 16 is overlaid on the second end part 12*b* and the middle part 12*c* of the main plate 12 in the same manner described above. Specifically, the second scale plate 16 is overlaid on the main plate 12 such that the front and rear clamping parts 106*a* and 106*b* (FIG. 10) of the second scale plate 16 extend through the window portion 72 (FIGS. 5 and 6) of the main plate 12 to engage with the outer periphery of the second cleat 52, and then the second scale plate 16 slides into the gap 78*a* defined between the retaining tab 78 and the main plate 12. As shown in FIG. 21, the retainer 20 is positioned at the second ends 80*b* of the slits 80 of the main plate 12 for measuring the cleat mounting position of the second cleat 52 with respect to the second bicycle shoe 50.

Then, the cleat mounting position of the second cleat 52 with respect to the second bicycle shoe 50 is measured by using the second straight scales 84 and the third straight scale 86 of the main plate 12, and the third angle scales 102 and the fourth angle scale 104 of the second scale plate 16.

More specifically, a lengthwise position of the second cleat 52 is measured by using the second straight scales 84 of the main plate 12 and the third angle scales 102 of the second scale plate 16. Specifically, as shown in FIG. 22, a parallel pair of a line segment of one of the second straight scales 84 and a line segment of corresponding one of the third angle scales 102 is found. Then, the value corresponding to the found line segment of the one of the second straight scales 84 in the one of the second straight scales 84 is measured as the lengthwise position of the second cleat 52 with respect to the second bicycle shoe 50. In the illustrated embodiment, since the plate body 100 of the second scale plate 16 is transparent, the value of the second straight scale 84 of the main plate 12 can be read through the second scale plate 16.

Figure 22:
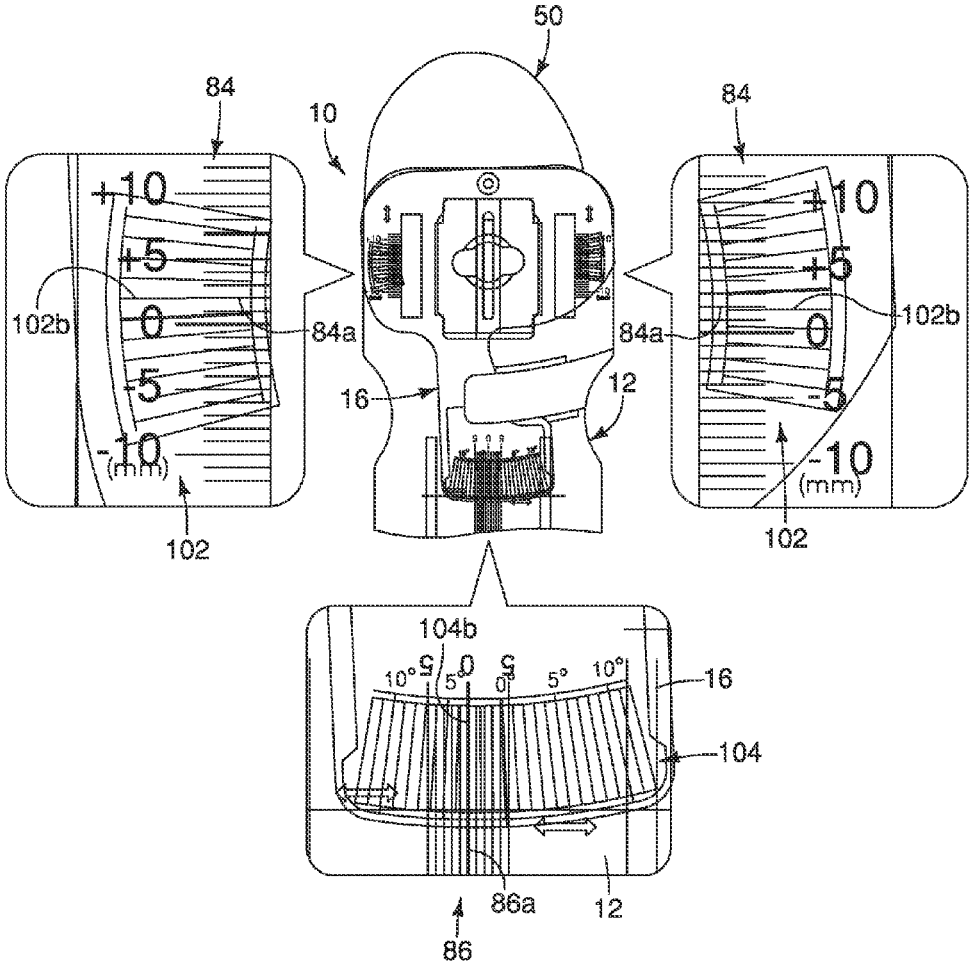
FIG. 22 is a partial top plan view of the measurement assembly of the bicycle cleat positioning kit, illustrating an example of measurement of the cleat mounting position of the mountain bike cleat relative to the mountain bike shoe.

For example, as shown in FIG. 22, a line segment 84*a* of the second straight scale 84 on the right side is parallel to a line segment 102*b* of the third angle scale 102 on the right side. The value corresponding to the line segment 84*a* of the second straight scale 84 is "+2" as shown in FIG. 22. In the illustrated embodiment, when the second cleat 52 is adjusted relative to a reference position of the second bicycle shoe 50 towards a toe-side of the second bicycle shoe 50, then the lengthwise position of the second cleat 52 becomes positive value. On the other hand, when the second cleat 52 is adjusted relative to the reference position of the second bicycle shoe 50 toward a heel-side of the second bicycle shoe 50, then the lengthwise position of the second cleat 52 becomes negative value. Thus, in this illustrated example, the second cleat 52 is adjusted relative to the reference position of the second bicycle shoe 50 towards the toe-side by 2 mm. Of course, this relationship between the adjustment directions of the second cleat 52 relative to the reference position of the second bicycle shoe 50 and the signs of the value can be oppositely defined. Furthermore, in the illustrated example, a line segment 84*a* of the second straight scale 84 on the left side is also parallel to a line segment 102*b* of the third angle scale 102 on the left side. The value corresponding to the line segment 84*a* of the second straight scale 84 is "+2" as shown in FIG. 22. However, the lengthwise position of the second cleat 52 can be measured if one parallel pair of a line segment of one of the second straight scales 84 and a line segment of corresponding one of the third angle scales 102 is found.

Furthermore, a widthwise position of the second cleat 52 and an angle of the second cleat 52 are measured by using the third straight scale 86 of the main plate 12 and the fourth angle scale 104 of the second scale plate 16. Specifically, as shown in FIG. 22, a parallel pair of a line segment of the third straight scale 86 and a line segment of the fourth angle scale 104 is found. Then, the value corresponding to the found line segment of the third straight scale 86 in the third straight scale 86 is measured as the widthwise position of the second cleat 52 with respect to the second bicycle shoe 50. In the illustrated embodiment, since the plate body 100 of the second scale plate 16 is transparent, the value of the third straight scale 86 of the main plate 12 can be read through the second scale plate 16. Furthermore, the value corresponding to the found line segment of the fourth angle scale 104 in the fourth angle scale 104 is measured as the angle of the second cleat 52 with respect to the second bicycle shoe 50.

For example, as shown in FIG. 22, a line segment 86*b* of the third straight scale 86 is parallel to a line segment 104*b* of the fourth angle scale 104. The value corresponding to the line segment 86*a* of the third straight scale 86 is "0" as shown in FIG. 22, which indicates that the second cleat 52 is aligned to the reference position in the widthwise direction. When recording the widthwise position of the second cleat 52, the value corresponding to the line segment 86*b* of the third straight scale 86 is recorded with signs, such as "IN" and "OUT" to clarify the adjustment directions of the second cleat 52 relative to the reference position of the second bicycle shoe 50. For example, when the second cleat 52 is adjusted relative to the reference position of the second bicycle shoe 50 towards inboard side of the second bicycle shoe 50, then the value corresponding to the line segment 86*b* of the third straight scale 86 is recorded with sign "IN." On the other hand, when the second cleat 52 is adjusted relative to the reference position of the second bicycle shoe 50 towards outboard side of the second bicycle shoe 50, then the value corresponding to the line segment 86*b* of the third straight scale 86 is recorded with sign "OUT." Of course, this relationship between the adjustment directions of the second cleat 52 relative to the reference position of the second bicycle shoe 50 and the signs of the value can be oppositely defined.

Furthermore, the value corresponding to the line segment 104*b* of the fourth angle scale 104 is "3" as shown in FIG. 22, which indicates that the second cleat 52 is rotated in the counter-clockwise direction in FIG. 22 by 3 degrees relative to a reference orientation of the second bicycle shoe 50. When recording the angle of the second cleat 52, the value corresponding to the line segment 104*b* of the fourth angle scale 104 is recorded with signs, such as "IN" and "OUT" to clarify the adjustment directions of the second cleat 52 relative to the reference orientation of the second bicycle shoe 50. For example, when the second cleat 52 is adjusted relative to the reference orientation of the second bicycle shoe 50 such that the toe of the second bicycle shoe 50 is arranged farther from a center line of a bicycle frame than the heel of the second bicycle shoe 50 (i.e., "toe-out" or "open stance") while the second bicycle shoe 50 is attached to a bicycle pedal with the second cleat 52, then the value corresponding to the line segment 104*a* of the fourth angle scale 104 is recorded with sign "IN." On the other hand, when the second cleat 52 is adjusted relative to the reference orientation of the second bicycle shoe 50 such that the toe of the second bicycle shoe 50 is arranged closer to the center line of the bicycle frame than the heel of the second bicycle shoe 50 (i.e., "toe-in" or "closed stance") while the second bicycle shoe 50 is attached to the bicycle pedal with the second cleat 52, then the value corresponding to the line segment 104*a* of the fourth angle scale 104 is recorded with sign "OUT." Of course, this relationship between the adjustment directions of the second cleat 52 relative to the reference orientation of the second bicycle shoe 50 and the signs of the value can be oppositely defined.

In the illustrated embodiment, the second straight scales 84 and the third straight scale 86 form the second shoe reference indicator of the present invention. Thus, in the illustrated embodiment, the second shoe attachment portion 32 of the main plate 12 has the second shoe reference indicator with respect to the second bicycle shoe 50. Furthermore, in the illustrated embodiment, the third angle scales 102 and the fourth angle scale 104 form the second cleat adjusting indicator of the present invention. Thus, in the illustrated embodiment, the second cleat engagement portion 36 of the second scale plate 16 has the second cleat adjusting indicator. The second cleat adjusting indicator is indicative of adjustment amounts of the second cleat 52 with respect to the second shoe reference indicator.

In the illustrated embodiment, the measured cleat mounting position (i.e., the lengthwise position, the widthwise position, and the angle) are used for attaching a bicycle cleat to a bicycle shoe at the same position as the measured cleat mounting position while newly installing the bicycle cleat to the bicycle shoe or while replacing an old bicycle cleat. On the other hand, the bicycle cleat positioning kit 10 assembled as shown in FIG. 21 can also be used for fine-tuning the cleat mounting position of the second cleat 52 relative to the second bicycle shoe 50. Specifically, the bicycle cleat positioning kit 10 is assembled in an identical manner as shown in FIG. 21, except that the cleat mounting bolts 56 are not fully tightened to the screw holes 50*c* of the second sole 54 such that the second cleat 52 is adjustable relative to the second bicycle shoe 50. Then, the second scale plate 16 is adjusted relative to the main plate 12 until a desired lengthwise position, a desired widthwise position, and a desired angle can be obtained.

In the illustrated embodiment, while the first bicycle shoe 40 is illustrated as a road bike shoe and the second bicycle shoe 50 is illustrated as a mountain bike shoe, it will be apparent to those skilled in the art from this disclosure that the first and second bicycle shoes 40 and 50 can be other types of bicycle shoes, respectively. Specifically, as shown in FIGS. 3 and 4, the second bicycle shoe 50 is different from the first bicycle shoe 40. However, alternatively or optionally, the bicycle cleat positioning kit 10 can be modified to be applied to the same type of bicycle shoes with different types of bicycle cleats. Furthermore, while the first cleat 42 is illustrated as a road bike cleat, such as SPD-SL, and the second bicycle shoe 50 is illustrated as a mountain bike cleat, such as SPD, it will be apparent to those skilled in the art from this disclosure that the first and second cleats 42 and 52 can be other types of bicycle cleats, respectively. For example, the bicycle cleat positioning kit 10 can also be modified to be applied to the same type of bicycle cleats (e.g., road bike cleats or mountain bike cleats) with different shapes, respectively.

In the illustrated embodiment, the main plate 12 is configured to be coupled to the first cleat 42 and the first scale plate 14 is configured to be coupled to the first bicycle shoe 40. On the other hand, for the mountain bike shoe, the main plate 12 is configured to be coupled to the second bicycle shoe 50 and the second scale plate 16 is configured to be coupled to the second cleat 52. Alternatively, the main plate 12 and the first scale plate 14 can be configured such that the main plate 12 is coupled to the first bicycle shoe 40 and the first scale plate 14 is coupled to the first cleat 42. Similarly, the main plate 12 and the second scale plate 16 can be configured such that the main plate 12 is coupled to the second cleat 52 and the second scale plate 16 is coupled to the second bicycle shoe 50.

In the illustrated embodiment, as shown in FIGS. 5 and 6, the first cleat engagement portion 34 has the aperture 60*a* within which the first cleat 42 is fittedly disposed. Alternatively or additionally, the bicycle cleat positioning kit 10 can include a modified second cleat engagement portion having an aperture within which the second cleat 52 is fittedly disposed. This modified second cleat engagement portion can be disposed on the main plate 12 or the second scale plate 16. With this configuration, the second cleat engagement portion (e.g., at least one of the first and second cleat engagement portions) can have an aperture within which the second cleat 52 (e.g., corresponding one of the first and second cleats) is configured to be fittedly disposed.

In the illustrated embodiment, as shown in FIG. 10, the second cleat engagement portion 36 has the front and rear clamping parts 106*a* and 106*b* that are engaged with the outer periphery of second cleat 52. Alternatively or additionally, the bicycle cleat positioning kit 10 can include a modified clamping part that is engaged with an outer periphery of the first cleat 42. This modified clamping part can be disposed on the main plate 12 or the first scale plate 14. With this configuration, the first cleat engagement portion (e.g., at least one of the first and second cleat engagement portions) can have a clamping part that is configured to be engaged with the outer periphery of the first cleat 42 (e.g., corresponding one of the first and second cleats).

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. The term "attached" or "attaching", as used herein, encompasses configurations in which an element directly secured to another element by affixing the element is directly to the other element; configurations in which the element is indirectly secured to the other element by affixing the element to the intermediate member(s) which in turn are affixed to the other element; and configurations in which one element is integral with another element, i.e. one element is essentially part of the other element. This definition also applies to words of similar meaning, for example, "joined", "connected", "coupled", "mounted", "bonded", "fixed" and their derivatives. Also, the terms "part," "section," "portion," "member" or "element" when used in the singular can have the dual meaning of a single part or a plurality of parts. Also it will be understood that although the terms "first" and "second" may be used herein to describe various components these components should not be limited by these terms. These terms are only used to distinguish one component from another. Thus, for example, a first component discussed above could be termed a second component and vice-a-versa without departing from the teachings of the present invention. Finally, terms of degree such as "substantially", "about" and "approximately" as used herein mean an amount of deviation of the modified term such that the end result is not significantly changed.

While only a preferred embodiment has been chosen to illustrate the present invention, it will be apparent to those skilled in the art from this disclosure that various changes and modifications can be made herein without departing from the scope of the invention as defined in the appended claims. Moreover, the size, shape, location or orientation of the various components can be changed as needed and/or desired so long as they do not substantially their intended function. Components that are shown directly connected or contacting each other can have intermediate structures disposed between them unless specifically stated otherwise. The functions of one element can be performed by two, and vice versa unless specifically stated otherwise. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the foregoing descriptions of the embodiment according to the present invention are provided for illustration only, and not for the purpose of limiting the invention as defined by the appended claims and their equivalents.

What is claimed is:

1. A bicycle cleat positioning kit comprising:

a first section having a first shoe attachment portion that is configured to be detachably coupled to a first bicycle shoe, the first section being configured to adjustably position a first cleat on a first sole of the first bicycle shoe, the first section including a first cleat engagement portion configured to be detachably coupled to the first cleat; and a second section having a second shoe attachment portion that is configured to be detachably coupled to a second bicycle shoe different from the first bicycle shoe, the second section being configured to adjustably position a second cleat on a second sole of the second bicycle shoe, the second section including a second cleat engagement portion configured to be detachably coupled to the second cleat, the first section being arranged at a first end of the bicycle cleat positioning kit and the second section being arranged at a second end of the cleat positioning kit, the second end being disposed opposite the first end in a lengthwise direction of the bicycle cleat positioning kit, the lengthwise direction corresponding to a direction from a heel to a toe of the first or second bicycle shoe when the first shoe attachment portion is coupled to the first bicycle shoe or the second shoe attachment portion is coupled to the second bicycle shoe, the first and second cleat engagement portions being shaped differently from each other to accommodate differently shaped first and second cleats, respectively.

2. The bicycle cleat positioning kit according to claim 1, wherein the first and second cleat engagement portions are movably arranged with respect to the first and second shoe attachment portions, respectively.

3. The bicycle cleat positioning kit according to claim 2, wherein the first cleat engagement portion is movable with the first cleat with respect to the first bicycle shoe while the first cleat is adjustably coupled to the first bicycle shoe, and the second cleat engagement portion is movable with the second cleat with respect to the second bicycle shoe while the second cleat is adjustably coupled to the second bicycle shoe.

4. The bicycle cleat positioning kit according to claim 1, wherein the first cleat engagement portion is movable with the first cleat with respect to the first bicycle shoe while the first shoe attachment portion is stationary with respect to the first bicycle shoe, and the second cleat engagement portion is movable with the second cleat with respect to the second bicycle shoe while the second shoe attachment portion is stationary with respect to the second bicycle shoe.

5. The bicycle cleat positioning kit according to claim 1, wherein at least one of the first and second cleat engagement portions has an aperture within which corresponding one of the first and second cleats is configured to be fittedly disposed.

6. The bicycle cleat positioning kit according to claim 1, wherein at least one of the first and second cleat engagement portions has a clamping part that is configured to be engaged with an outer periphery of corresponding one of the first and second cleats.

7. The bicycle cleat positioning kit according to claim 1, wherein at least one of the first and second shoe attachment portions includes an engagement structure that is configured to be engaged with a cleat attachment portion of corresponding one of the first and second bicycle shoes.

8. The bicycle cleat positioning kit according to claim 1, wherein the first and second shoe attachment portions have first and second shoe reference indicators with respect to the first and second bicycle shoes, respectively, and the first and second cleat engagement portions have first and second cleat adjusting indicators, respectively, the first and second cleat adjusting indicators being indicative of adjustment amounts of the first and second cleats with respect to the first and second shoe reference indicators, respectively.

9. The bicycle cleat positioning kit according to claim 1, wherein a retainer movable with respect to the first and second sections, the retainer being arranged to retain the first shoe attachment portion with respect to the first cleat engagement portion while the first cleat is adjustably coupled to the first bicycle shoe, the retainer being arranged to retain the second shoe attachment portion with respect to the second cleat engagement portion while the second cleat is adjustably coupled to the second bicycle shoe.

10. The bicycle cleat positioning kit according to claim 1, wherein the first cleat engagement portion of the first section and the second shoe attachment portion of the second section are integrally formed as a one-piece, unitary member.

11. The bicycle cleat positioning kit according to claim 10, wherein the first shoe attachment portion is independently formed as a separate member from the first cleat engagement portion and the second shoe attachment portion, and the second cleat engagement portion is independently formed as a separate member from the first cleat engagement portion and the second shoe attachment portion.

12. The bicycle cleat positioning kit according to claim 11, wherein at least a part of the first shoe attachment portion is overlaid on the first cleat engagement portion while the first shoe attachment portion is attached to the first bicycle shoe and the first cleat engagement portion is attached to the first cleat, and at least a part of the second cleat engagement portion is overlaid on the second shoe attachment portion while the second shoe attachment portion is attached to the second bicycle shoe and the second cleat engagement portion is attached to the second cleat.

13. The bicycle cleat positioning kit according to claim 1, further comprising:

a main plate having an elongated shape, the main plate including a first end part and a second end part disposed opposite the first end part in a lengthwise direction of the main plate, the first shoe attachment portion and first cleat engaging portion being disposed on the first end part, the second shoe attachment portion and second cleat engaging portion being disposed on the second end part.

14. The bicycle cleat positioning kit according to claim 13, wherein the first cleat engagement portion is formed by a part of the main plate, and the second cleat engagement portion is formed by a part of a separate piece that is separate from the main plate.

15. The bicycle cleat positioning kit according to claim 1, wherein the first cleat engagement portion is configured to engage with a road bike cleat as the first cleat, and the second cleat engagement portion is configured to engage with a mountain bike cleat as the second cleat.

16. A bicycle cleat positioning kit comprising:

a first section having a first shoe attachment portion that is configured to be detachably coupled to a first bicycle shoe, the first section being configured to adjustably position a first cleat on a first sole of the first bicycle shoe, the first section including a first cleat engagement portion configured to be detachably coupled to the first cleat; and a second section having a second shoe attachment portion that is configured to be detachably coupled to a second bicycle shoe different from the first bicycle shoe, the second section being configured to adjustably position a second cleat on a second sole of the second bicycle shoe, the second section including a second cleat engagement portion configured to be detachably coupled to the second cleat, the first and second cleat engagement portions being shaped differently from each other to accommodate differently shaped first and second cleats, respectively, at least one of the first and second shoe attachment portions including an engagement structure that is configured to be engaged with a cleat attachment portion of a corresponding one of the first and second bicycle shoes, the engagement structure having a screw part that is threadedly coupled to a screw hole of the cleat attachment portion.

17. The bicycle cleat positioning kit according to claim 7, wherein the engagement structure has a protruding part that mates with recess of the cleat attachment portion.

18. A bicycle cleat positioning kit comprising:

a first section having a first shoe attachment portion that is configured to be detachably coupled to a first bicycle shoe, the first section being configured to adjustably position a first cleat on a first sole of the first bicycle shoe the first section including a first cleat engagement portion configured to be detachably coupled to the first cleat;

a second section having a second shoe attachment portion that is configured to be detachably coupled to a second bicycle shoe different from the first bicycle shoe the second section being configured to adjustably position a second cleat on a second sole of the second bicycle shoe, the second section including a second cleat engagement portion configured to be detachably coupled to the second cleat, the first and second cleat engagement portions being shaped differently from each other to accommodate differently shaped first and second cleats, respectively; and a cleat adjustment member having a support bar, a pair of pointing parts that are slidably attached to the support bar and extend in a direction perpendicular to a direction in which the support bar extends, and a first coupling portion and a second coupling portion that are attached to the support bar between the pointing parts, the first coupling portion configured to be selectively coupled to the first cleat engagement portion while the first cleat is adjustably coupled to the first bicycle shoe and the second coupling portion configured to be selectively coupled to the second cleat engagement portion while the second cleat is adjustably coupled to the second bicycle shoe.

19. The bicycle cleat positioning kit according to claim 18, wherein the cleat adjustment member is movably arranged with respect to the first shoe attachment portion while the cleat adjustment member is coupled to the first cleat engagement portion, and the cleat adjustment member is movably arranged with respect to the second shoe attachment portion while the cleat adjustment member is coupled to the second cleat engagement portion.

20. The bicycle cleat positioning kit according to claim 19, wherein the cleat adjustment member is movable with the first cleat with respect to the first bicycle shoe while the first cleat is adjustably coupled to the first bicycle shoe, and the cleat adjustment member is movable with the second cleat with respect to the second bicycle shoe while the second cleat is adjustably coupled to the second bicycle shoe.

21. The bicycle cleat positioning kit according to claim 20, wherein the cleat adjustment member is adjustable relative to a first reference position on the first bicycle shoe while the first cleat is adjustably coupled to the first bicycle shoe, and the cleat adjustment member is adjustable relative to a second reference position on the second bicycle shoe while the second cleat is adjustably coupled to the second bicycle shoe.

* * * * *